US008205674B2

(12) United States Patent
Shurtleff

(10) Patent No.: US 8,205,674 B2
(45) **Date of Patent: *Jun. 26, 2012**

(54) APPARATUS, SYSTEM, AND METHOD FOR IN-SITU EXTRACTION OF HYDROCARBONS

(75) Inventor: J. Kevin Shurtleff, Orem, UT (US)

(73) Assignee: Mountain West Energy Inc., Orem, UT (US)

( * ) Notice: Subject to any disclaimer, the term of this patent is extended or adjusted under 35 U.S.C. 154(b) by 314 days.

This patent is subject to a terminal disclaimer.

(21) Appl. No.: 11/782,463

(22) Filed: Jul. 24, 2007

(65) Prior Publication Data

US 2008/0023197 A1 Jan. 31, 2008

Related U.S. Application Data

(60) Provisional application No. 60/820,256, filed on Jul. 25, 2006.

(51) Int. Cl.
*E21B 36/00* (2006.01)
*E21B 43/24* (2006.01)
*E21B 43/00* (2006.01)

(52) U.S. Cl. ..... 166/303; 166/302; 166/67; 166/260; 166/261

(58) Field of Classification Search ..... 166/59, 166/257, 258, 259, 313
See application file for complete search history.

(56) References Cited

U.S. PATENT DOCUMENTS 2,642,943 A 6/1953 Smith et al.
3,149,670 A * 9/1964 Grant ..... 166/259
3,172,470 A * 3/1965 Huitt et al. ..... 166/257
3,237,689 A * 3/1966 Justheim ..... 376/275
3,241,611 A 3/1966 Dougan ..... 166/7
3,242,989 A * 3/1966 Schlicht et al. ..... 166/52
3,254,711 A 6/1966 Parker
3,285,335 A 11/1966 Reistle ..... 166/252
3,294,167 A 12/1966 Vogel ..... 166/272.1
3,349,846 A 10/1967 Trantham et al.
3,498,391 A 3/1970 Goodman et al.
3,503,868 A 3/1970 Shields
3,593,790 A 7/1971 Herce (Continued)

OTHER PUBLICATIONS

"Secure Fuels from Domestic Resources; The Continuing Evolution of America's Oil Shale and Tar Sand Industries; Profiles of Companies Investing Today to Secure America's Energy Future," U.S. Dept. of Energy, Jun. 2007, 68 pgs.

(Continued)

*Primary Examiner* — Angela M DiTrani
(74) *Attorney, Agent, or Firm* — Kunzler Needham Massey & Thorpe

(57) ABSTRACT

An apparatus, system, and method are disclosed for in-situ extraction of hydrocarbons from a hydrocarbon-bearing formation. The system includes a well drilled through a hydrocarbon-bearing formation, and a completion unit that places an injection tube near a fluid injection point near the bottom of a target zone and a production tube near a fluid production point near the top of the target zone. An isolation unit isolates the fluid injection point from the fluid production point such that injected fluid flows through the target zone. The system further includes a heat source, and a fluid that delivers thermal energy from the heat source to the hydrocarbons in the target zone to entrain the hydrocarbons in the fluid. The resulting production fluid is heated, free hydrogen is added, and the production fluid is treated on a catalytic reactor to reduce the size of the hydrocarbon chains.

35 Claims, 14 Drawing Sheets

U.S. PATENT DOCUMENTS

| | | | | | |
|---|---|---|---|---|---|
| 3,617,472 | A | | 11/1971 | Schlinger et al. | |
| 3,980,137 | A | * | 9/1976 | Gray | 166/256 |
| 4,001,105 | A | | 1/1977 | Gifford | 208/11 |
| 4,015,664 | A | | 4/1977 | Acheson et al. | 166/259 |
| 4,047,760 | A | | 9/1977 | Ridley | 299/2 |
| 4,059,308 | A | | 11/1977 | Pearson et al. | 299/5 |
| 4,060,479 | A | | 11/1977 | Barcello | 208/11 |
| 4,065,183 | A | | 12/1977 | Hill et al. | 299/4 |
| 4,083,604 | A | | 4/1978 | Bohn et al. | 299/4 |
| 4,110,988 | A | | 9/1978 | Hyder | |
| 4,118,925 | A | * | 10/1978 | Sperry et al. | 60/775 |
| 4,119,349 | A | | 10/1978 | Albulesca et al. | 299/2 |
| 4,120,354 | A | | 10/1978 | Ridley et al. | 166/251 |
| 4,130,474 | A | | 12/1978 | Anthony | 208/11 |
| 4,140,343 | A | | 2/1979 | Mills | 299/2 |
| 4,143,917 | A | | 3/1979 | Sweany | 299/2 |
| 4,149,752 | A | | 4/1979 | Cha et al. | 299/2 |
| 4,153,299 | A | | 5/1979 | Kvapil et al. | 299/2 |
| 4,153,300 | A | | 5/1979 | Kvapil et al. | 299/2 |
| 4,158,467 | A | | 6/1979 | Larson et al. | 299/2 |
| 4,158,638 | A | | 6/1979 | Tsai | 208/11 |
| 4,162,706 | A | | 7/1979 | Cha | 166/251 |
| 4,162,808 | A | | 7/1979 | Kvapil et al. | 299/2 |
| 4,163,580 | A | | 8/1979 | Pearson et al. | 299/5 |
| 4,167,213 | A | | 9/1979 | Stoltz et al. | 166/251 |
| 4,185,693 | A | | 1/1980 | Crumb et al. | 166/259 |
| 4,185,871 | A | | 1/1980 | Kvapil et al. | 299/2 |
| 4,194,788 | A | | 3/1980 | Miller | 299/2 |
| 4,199,026 | A | | 4/1980 | McCollum | 166/250.15 |
| 4,223,726 | A | | 9/1980 | Cha | 166/251 |
| 4,223,734 | A | | 9/1980 | Lekas | 166/299 |
| 4,231,617 | A | | 11/1980 | Larson et al. | 299/2 |
| 4,265,307 | A | | 5/1981 | Elkin | 166/248 |
| 4,265,486 | A | | 5/1981 | Durbin et al. | 299/2 |
| 4,266,609 | A | | 5/1981 | Rom et al. | 166/251 |
| 4,266,612 | A | | 5/1981 | French | 166/299 |
| 4,267,062 | A | | 5/1981 | Byerley | |
| 4,271,904 | A | | 6/1981 | Ginsburgh et al. | 166/251 |
| RE30,738 | E | | 9/1981 | Bridges et al. | 166/248 |
| 4,320,994 | A | | 3/1982 | Mallon | 405/267 |
| 4,323,120 | A | | 4/1982 | Ginsburgh et al. | 166/251 |
| 4,323,121 | A | | 4/1982 | Ginsburgh et al. | 166/251 |
| 4,327,805 | A | * | 5/1982 | Poston | 166/401 |
| 4,343,360 | A | | 8/1982 | Ginsburgh et al. | 166/251 |
| 4,343,361 | A | | 8/1982 | Ginsburgh et al. | 166/251 |
| 4,366,986 | A | | 1/1983 | Bohn et al. | 299/2 |
| 4,373,581 | A | | 2/1983 | Toellner | 166/53 |
| 4,375,302 | A | | 3/1983 | Kalmar | 299/4 |
| 4,376,015 | A | | 3/1983 | Spars | 299/2 |
| 4,378,949 | A | | 4/1983 | Miller | 201/17 |
| 4,398,597 | A | | 8/1983 | Haberman | 166/57 |
| 4,399,867 | A | * | 8/1983 | Wolcott | 166/261 |
| 4,401,163 | A | | 8/1983 | Elkins | 166/259 |
| 4,410,416 | A | | 10/1983 | Everman | 208/11 |
| 4,413,678 | A | | 11/1983 | Gillespie | 166/57 |
| 4,415,034 | A | * | 11/1983 | Bouck | 166/302 |
| 4,417,449 | A | | 11/1983 | Hegarty et al. | 62/28 |
| 4,419,218 | A | | 12/1983 | Angevine et al. | 208/59 |
| 4,436,153 | A | | 3/1984 | Carlson | 166/260 |
| 4,437,519 | A | | 3/1984 | Cha | 166/259 |
| 4,449,994 | A | | 5/1984 | Hegarty et al. | 62/17 |
| 4,450,910 | A | * | 5/1984 | Hunt, III | 166/251.1 |
| 4,454,915 | A | | 6/1984 | York et al. | 166/259 |
| 4,458,946 | A | | 7/1984 | Hanna et al. | 299/2 |
| 4,475,347 | A | | 10/1984 | Hegarty et al. | 62/17 |
| 4,483,398 | A | | 11/1984 | Peters et al. | 166/259 |
| 4,495,032 | A | | 1/1985 | Everman | 202/105 |
| 4,495,054 | A | | 1/1985 | Claflin | 208/8 |
| 4,502,942 | A | | 3/1985 | Lee et al. | 208/11 |
| 4,521,297 | A | | 6/1985 | Angeuine et al. | 208/89 |
| 4,522,265 | A | | 6/1985 | Yen et al. | 166/307 |
| 4,545,622 | A | | 10/1985 | Yang | 299/2 |
| 4,560,205 | A | | 12/1985 | Ricketts | 299/2 |
| 4,579,173 | A | | 4/1986 | Rosensweig et al. | 166/248 |
| 4,706,751 | A | | 11/1987 | Gondouin | |
| 4,737,267 | A | | 4/1988 | Pao et al. | 208/432 |
| 4,815,790 | A | | 3/1989 | Rosar et al. | 299/4 |
| 4,824,441 | A | | 4/1989 | Kindig | 44/604 |
| 4,891,131 | A | | 1/1990 | Sadeghi et al. | 208/390 |
| 5,014,787 | A | * | 5/1991 | Duerksen | 166/303 |
| 5,024,487 | A | | 6/1991 | Woestemeyer | 299/2 |
| 5,055,180 | A | | 10/1991 | Klaila | 208/402 |
| 5,058,675 | A | | 10/1991 | Travis | 166/272 |
| 5,059,404 | A | | 10/1991 | Mansour et al. | 423/201 |
| 5,104,787 | A | * | 4/1992 | Lindstrom et al. | 435/1.1 |
| 5,122,259 | A | | 6/1992 | Nielson | 208/407 |
| 5,178,733 | A | | 1/1993 | Nielson | 202/84 |
| 5,201,219 | A | | 4/1993 | Bandurski et al. | 73/153 |
| 5,236,039 | A | | 8/1993 | Edelstein et al. | 166/248 |
| 5,255,740 | A | | 10/1993 | Talley | 166/272 |
| 5,306,481 | A | | 4/1994 | Mansour et al. | 423/652 |
| 5,325,797 | A | | 7/1994 | Mei | 110/245 |
| 5,388,456 | A | | 2/1995 | Kettel | 73/152 |
| 5,536,488 | A | | 7/1996 | Mansour | 423/652 |
| 5,637,192 | A | | 6/1997 | Mansour | 162/29 |
| 5,700,107 | A | | 12/1997 | Newton | 405/128 |
| 5,763,247 | A | | 6/1998 | Mollet | 502/4 |
| 5,795,464 | A | | 8/1998 | Sankey | 208/391 |
| 5,829,519 | A | | 11/1998 | Uthe | 166/60 |
| 5,868,202 | A | | 2/1999 | Hsu | 166/256 |
| 5,895,769 | A | | 4/1999 | Lai | 502/4 |
| 6,015,015 | A | | 1/2000 | Luft et al. | 166/384 |
| 6,079,499 | A | | 6/2000 | Mikus et al. | 166/401 |
| 6,149,765 | A | | 11/2000 | Mansour | 162/29 |
| 6,540,018 | B1 | | 4/2003 | Vinegar et al. | |
| 6,554,368 | B2 | | 4/2003 | Drake | 299/8 |
| 6,581,684 | B2 | | 6/2003 | Wellington | 166/245 |
| 6,588,503 | B2 | | 7/2003 | Karanikas | 166/245 |
| 6,588,504 | B2 | | 7/2003 | Wellington | 166/245 |
| 6,591,906 | B2 | | 7/2003 | Wellington | 166/250.01 |
| 6,591,907 | B2 | | 7/2003 | Zhang | 166/250.01 |
| 6,607,033 | B2 | | 8/2003 | Wellington et al. | 166/245 |
| 6,609,570 | B2 | | 8/2003 | Wellington et al. | 166/267 |
| 6,684,948 | B1 | | 2/2004 | Savage | 166/248 |
| 6,688,387 | B1 | | 2/2004 | Wellington et al. | 166/245 |
| 6,698,515 | B2 | | 3/2004 | Karanikas et al. | 166/245 |
| 6,702,016 | B2 | | 3/2004 | de Rouffignac et al. | 166/245 |
| 6,708,758 | B2 | | 3/2004 | de Rouffignac et al. | 166/245 |
| 6,712,135 | B2 | | 3/2004 | Wellington et al. | 166/245 |
| 6,712,136 | B2 | | 3/2004 | de Roufignac et al. | 166/245 |
| 6,712,137 | B2 | | 3/2004 | Vinegar et al. | 166/245 |
| 6,715,546 | B2 | | 4/2004 | Vinegar et al. | 166/245 |
| 6,715,547 | B2 | | 4/2004 | Vinegar et al. | 166/245 |
| 6,715,548 | B2 | | 4/2004 | Stegemeier et al. | 166/245 |
| 6,715,549 | B2 | | 4/2004 | Wellington et al. | 166/250.01 |
| 6,719,047 | B2 | | 4/2004 | Fowler et al. | 166/245 |
| 6,722,429 | B2 | | 4/2004 | de Rouffignac et al. | 166/245 |
| 6,722,430 | B2 | | 4/2004 | Vinegar et al. | 166/250.01 |
| 6,722,431 | B2 | | 4/2004 | Karanikas et al. | 166/251.1 |
| 6,725,920 | B2 | | 4/2004 | Zhang et al. | 166/245 |
| 6,725,921 | B2 | | 4/2004 | de Roufignac et al. | 166/245 |
| 6,725,928 | B2 | | 4/2004 | Vinegar et al. | 166/257 |
| 6,729,395 | B2 | | 5/2004 | de Roufignac et al. | 166/245 |
| 6,729,396 | B2 | | 5/2004 | Vinegar et al. | 166/245 |
| 6,729,397 | B2 | | 5/2004 | Zhang et al. | 166/250.01 |
| 6,729,401 | B2 | | 5/2004 | Vinegar et al. | 166/267 |
| 6,732,794 | B2 | | 5/2004 | Wellington et al. | 166/245 |
| 6,732,795 | B2 | | 5/2004 | de Roufignac et al. | 166/245 |
| 6,732,796 | B2 | | 5/2004 | Vinegar et al. | 166/259 |
| 6,736,215 | B2 | | 5/2004 | Maher et al. | 166/402 |
| 6,739,393 | B2 | | 5/2004 | Vinegar et al. | 166/245 |
| 6,739,394 | B2 | | 5/2004 | Vinegar et al. | 166/245 |
| 6,742,587 | B2 | | 6/2004 | Vinegar et al. | 166/245 |
| 6,742,588 | B2 | | 6/2004 | Wellington et al. | 166/245 |
| 6,742,589 | B2 | | 6/2004 | Berchenko et al. | 166/245 |
| 6,742,593 | B2 | | 6/2004 | de Rouffignac et al. | 166/302 |
| 6,745,831 | B2 | | 6/2004 | Fowler et al. | 166/245 |
| 6,745,832 | B2 | | 6/2004 | Wellington et al. | 166/245 |
| 6,745,837 | B2 | | 6/2004 | Wellington et al. | 166/302 |
| 6,749,021 | B2 | | 6/2004 | Vinegar et al. | 166/245 |
| 6,752,210 | B2 | | 6/2004 | de Rouffignac et al. | 166/302 |
| 6,758,268 | B2 | | 7/2004 | Vinegar et al. | 166/245 |
| 6,761,216 | B2 | | 7/2004 | Vinegar et al. | 166/245 |
| 6,763,886 | B2 | | 7/2004 | Schoeling et al. | 166/302 |
| 6,769,483 | B2 | | 8/2004 | de Rouffignac et al. | 166/60 |
| 6,769,485 | B2 | | 8/2004 | Vinegar et al. | 166/245 |
| 6,782,947 | B2 | | 8/2004 | de Roufignac et al. | 166/245 |

6,789,625 B2 9/2004 de Roufignac et al. ..... 166/302
6,805,195 B2 10/2004 Vinegar et al. ..... 166/251.1
6,820,688 B2 11/2004 Vinegar ..... 166/245
6,866,097 B2 3/2005 Vinegar et al. ..... 166/245
6,869,147 B2 3/2005 Drake ..... 299/8
6,871,707 B2 3/2005 Karanikas ..... 166/302
6,877,554 B2 4/2005 Stegemeier ..... 166/245
6,877,555 B2 4/2005 Karanikas ..... 166/245
6,880,633 B2 4/2005 Wellington ..... 166/245
6,880,635 B2 4/2005 Vinegar ..... 166/259
6,889,769 B2 5/2005 Wellington ..... 166/302
6,896,053 B2 5/2005 Berchenko ..... 166/245
6,902,003 B2 6/2005 Maher ..... 166/302
6,902,004 B2 6/2005 de Roufignac ..... 166/302
6,910,536 B2 6/2005 Wellington ..... 166/257
6,913,078 B2 7/2005 Shahin, Jr. ..... 166/245
6,915,850 B2 7/2005 Vinegar ..... 166/272.2
6,918,442 B2 7/2005 Wellington ..... 166/245
6,918,443 B2 7/2005 Wellington ..... 166/245
6,918,444 B2 7/2005 Passey ..... 166/258
6,923,257 B2 8/2005 Wellington ..... 166/245
6,923,258 B2 8/2005 Wellington ..... 166/245
6,929,067 B2 8/2005 Vinegar ..... 166/302
6,929,330 B2 8/2005 Drake ..... 299/8
6,932,155 B2 8/2005 Vinegar ..... 166/245
6,948,562 B2 9/2005 Wellington ..... 166/272.1
6,948,563 B2 9/2005 Wellington ..... 166/302
6,951,247 B2 10/2005 de Roufignac ..... 166/245
6,953,087 B2 10/2005 de Roufignac ..... 166/245
6,959,761 B2 11/2005 Berchenko ..... 166/245
6,964,300 B2 11/2005 Vinegar ..... 166/245
6,966,372 B2 11/2005 Wellington ..... 166/245
6,966,374 B2 11/2005 Vinegar ..... 166/272.3
6,969,123 B2 11/2005 Vinegar ..... 299/3
6,973,967 B2 12/2005 Stegemeier et al. ..... 166/245
6,981,548 B2 1/2006 Wellington et al. ..... 166/245
6,991,031 B2 1/2006 Vinegar et al. ..... 166/245
6,991,032 B2 1/2006 Berchenko et al. ..... 166/245
6,991,033 B2 1/2006 Wellington et al. ..... 166/245
6,991,036 B2 1/2006 Sumnu-Dindoruk et al. 166/302
6,991,045 B2 1/2006 Vinegar et al. ..... 175/45
6,994,160 B2 2/2006 Wellington et al. ..... 166/245
6,994,161 B2 2/2006 Maher et al. ..... 166/245
6,994,168 B2 2/2006 Wellington et al. ..... 166/302
6,994,169 B2 2/2006 Zhang et al. ..... 166/302
7,032,660 B2 4/2006 Vinegar et al. ..... 166/245
7,048,051 B2 5/2006 McQueen ..... 166/261
7,134,455 B2 11/2006 Hickman et al.
2001/0049342 A1 12/2001 Passey et al. ..... 507/200
2002/0027001 A1 3/2002 Wellington et al. ..... 166/59
2002/0029881 A1 3/2002 de Roufignac et al. .... 166/244.1
2002/0029882 A1 3/2002 de Roufignac et al. .... 166/244.1
2002/0029884 A1 3/2002 de Roufignac et al. ..... 166/257
2002/0029885 A1 3/2002 de Roufignac et al. ..... 166/302
2002/0030398 A1 3/2002 Drake et al. ..... 299/8
2002/0033253 A1 3/2002 de Roufignac et al. ..... 166/248
2002/0033254 A1 3/2002 Karanikas et al. ..... 166/248
2002/0033255 A1 3/2002 Fowler et al. ..... 166/251.1
2002/0033256 A1 3/2002 Wellington et al. ..... 166/261
2002/0033257 A1 3/2002 Shahin, Jr. et al. ..... 166/267
2002/0033280 A1 3/2002 Schoeling et al. ..... 175/61
2002/0034380 A1 3/2002 Maher et al. ..... 392/801
2002/0035307 A1 3/2002 Vinegar et al. ..... 585/943
2002/0036083 A1 3/2002 de Roufignac et al. ..... 16/245
2002/0036084 A1 3/2002 Vinegar et al. ..... 166/245
2002/0036089 A1 3/2002 Vinegar et al. ..... 166/302
2002/0036103 A1 3/2002 de Roufignac et al. ..... 175/61
2002/0038069 A1 3/2002 Wellington et al. ..... 585/943
2002/0038705 A1 4/2002 Wellington et al. ..... 166/59
2002/0038706 A1 4/2002 Zhang et al. ..... 166/59
2002/0038708 A1 4/2002 Wellington et al. ..... 166/245
2002/0038709 A1 4/2002 Wellington et al. ..... 166/245
2002/0038710 A1 4/2002 Maher et al. ..... 166/251.1
2002/0038711 A1 4/2002 de Roufignac et al. ..... 166/261
2002/0038712 A1 4/2002 Vinegar et al. ..... 166/267
2002/0039486 A1 4/2002 de Roufignac et al. ..... 392/301
2002/0040173 A1 4/2002 de Roufignac et al. ..... 585/1
2002/0040177 A1 4/2002 Maher et al. ..... 585/943
2002/0040778 A1 4/2002 Wellington et al. ..... 166/60
2002/0040779 A1 4/2002 Wellington et al. ..... 166/244.1
2002/0040780 A1 4/2002 Wellington et al. ..... 166/251.1
2002/0040781 A1 4/2002 Keedy et al. ..... 166/251.1
2002/0043365 A1 4/2002 Berchenko et al. ..... 166/59
2002/0043366 A1 4/2002 Wellington et al. ..... 166/251.1
2002/0043367 A1 4/2002 de Roufignac et al. ..... 166/60
2002/0043405 A1 4/2002 Vinegar et al. ..... 175/61
2002/0045553 A1 4/2002 Vinegar et al. ..... 507/200
2002/0046832 A1 4/2002 Zhang et al. ..... 166/60
2002/0046837 A1 4/2002 Wellington et al. ..... 166/257
2002/0046838 A1 4/2002 Karanikas et al. ..... 166/257
2002/0046839 A1 4/2002 Vinegar et al. ..... 166/267
2002/0046883 A1 4/2002 Wellington et al. ..... 175/61
2002/0049358 A1 4/2002 Vinegar et al. ..... 585/1
2002/0049360 A1 4/2002 Wellington et al. ..... 585/943
2002/0050352 A1 5/2002 Wellington et al. ..... 166/60
2002/0050353 A1 5/2002 Berchenko et al. ..... 166/245
2002/0050356 A1 5/2002 Vinegar et al. ..... 166/267
2002/0050357 A1 5/2002 Wellington et al. ..... 166/302
2002/0052297 A1 5/2002 de Roufignac et al. ..... 507/200
2002/0053429 A1 5/2002 Stegemeier et al. ..... 166/245
2002/0053431 A1 5/2002 Wellington et al. ..... 166/251.1
2002/0053432 A1 5/2002 Berchenko et al. ..... 166/267
2002/0053435 A1 5/2002 Vinegar et al. ..... 166/302
2002/0053436 A1 5/2002 Vinegar et al. ..... 166/302
2002/0056551 A1 5/2002 Wellington et al. ..... 166/257
2002/0056552 A1 5/2002 Wellington et al. ..... 166/302
2002/0057905 A1 5/2002 Wellington et al. ..... 392/301
2002/0062051 A1 5/2002 Wellington et al. ..... 585/1
2002/0062052 A1 5/2002 de Roufignac et al. ..... 585/1
2002/0062959 A1 5/2002 Wellington et al. ..... 166/251.1
2002/0062961 A1 5/2002 Vinegar et al. ..... 166/302
2002/0066565 A1 6/2002 de Roufignac et al. ..... 166/302
2002/0074117 A1 6/2002 Shahin, Jr. et al. ..... 166/248
2002/0076212 A1 6/2002 Zhang et al. ..... 392/301
2002/0077515 A1 6/2002 Wellington et al. ..... 585/1
2002/0084074 A1 7/2002 de Roufignac et al. ..... 166/303
2002/0096320 A1 7/2002 Wellington et al. ..... 166/248
2002/0104654 A1 8/2002 Vinegar et al. ..... 166/267
2002/0108753 A1 8/2002 Vinegar et al. ..... 166/245
2002/0117303 A1 8/2002 Vinegar et al. ..... 166/302
2002/0132862 A1 9/2002 Vinegar et al. ..... 518/703
2002/0170708 A1 11/2002 Vinegar et al. ..... 166/59
2002/0191968 A1 12/2002 Vinegar et al. ..... 392/301
2002/0191969 A1 12/2002 Wellington et al. ..... 392/301
2003/0006039 A1 1/2003 Zhang et al. ..... 166/302
2003/0019626 A1 1/2003 Vinegar et al. ..... 166/261
2003/0024699 A1 2/2003 Vinegar et al. ..... 166/244.1
2003/0038526 A1 2/2003 Drake et al. ..... 299/18
2003/0051872 A1 3/2003 de Roufignac et al. ..... 166/248
2003/0062154 A1 4/2003 Vinegar et al. ..... 166/60
2003/0062164 A1 4/2003 Wellington et al. ..... 166/303
2003/0066642 A1 4/2003 Wellington et al. ..... 166/245
2003/0066644 A1 4/2003 Karanikas et al. ..... 166/251.1
2003/0070807 A1 4/2003 Wellington et al. ..... 166/261
2003/0075318 A1 4/2003 Keedy et al. ..... 166/60
2003/0079877 A1 5/2003 Wellington et al. ..... 166/272.1
2003/0080604 A1 5/2003 Vinegar et al. ..... 299/14
2003/0085034 A1 5/2003 Wellington et al. ..... 166/248
2003/0098149 A1 5/2003 Wellington et al. ..... 166/52
2003/0098262 A1 5/2003 Rendall ..... 208/431
2003/0098605 A1 5/2003 Vinegar et al. ..... 299/14
2003/0100451 A1 5/2003 Messier et al. ..... 507/100
2003/0102124 A1 6/2003 Vinegar et al. ..... 166/256
2003/0102125 A1 6/2003 Wellington et al. ..... 166/266
2003/0102126 A1 6/2003 Sumnu-Dindoruk et al. ..... 166/272.1
2003/0102130 A1 6/2003 Vinegar et al. ..... 166/302
2003/0111223 A1 6/2003 de Roufignac et al. ..... 166/256
2003/0116315 A1 6/2003 Wellington et al. ..... 166/256
2003/0130136 A1 7/2003 de Roufignac et al. ..... 507/200
2003/0131993 A1 7/2003 Zhang et al. ..... 166/256
2003/0131994 A1 7/2003 Vinegar et al. ..... 166/256
2003/0131995 A1 7/2003 de Roufignac et al. .... 166/272.1
2003/0131996 A1 7/2003 Vinegar et al. ..... 166/272.1
2003/0136558 A1 7/2003 Wellington et al. ..... 166/245
2003/0136559 A1 7/2003 Wellington et al. ..... 166/250.01
2003/0137181 A1 7/2003 Wellington et al. ..... 299/5
2003/0141065 A1 7/2003 Karanikas et al. ..... 166/302

2003/0141066 A1 7/2003 Karanikas et al. ..... 166/302
2003/0141067 A1 7/2003 de Roufignac et al. ..... 166/302
2003/0141068 A1 7/2003 de Roufignac et al. ..... 166/302
2003/0142964 A1 7/2003 Wellington et al. ..... 507/200
2003/0146002 A1 8/2003 Vinegar et al. ..... 166/384
2003/0148894 A1 8/2003 Vinegar et al. ..... 507/200
2003/0155111 A1 8/2003 Vinegar et al. ..... 166/59
2003/0164234 A1 9/2003 de Rouffignac et al. ..... 166/248
2003/0164238 A1 9/2003 Vinegar et al. ..... 166/302
2003/0164239 A1 9/2003 Wellington et al. ..... 166/302
2003/0173072 A1 9/2003 Vinegar et al. ..... 166/66.5
2003/0173078 A1 9/2003 Wellington et al. ..... 166/250.07
2003/0173080 A1 9/2003 Berchenko et al. ..... 166/256
2003/0173081 A1 9/2003 Vinegar et al. ..... 166/272.1
2003/0173082 A1 9/2003 Vinegar et al. ..... 166/272.2
2003/0173085 A1 9/2003 Vinegar et al. ..... 166/302
2003/0178191 A1 9/2003 Maher et al. ..... 166/65.1
2003/0183390 A1 10/2003 Veenstra et al. ..... 166/302
2003/0192691 A1 10/2003 Vinegar et al. ..... 166/250.12
2003/0192693 A1 10/2003 Wellington ..... 166/267
2003/0196788 A1 10/2003 Vinegar et al. ..... 166/57
2003/0196789 A1 10/2003 Wellington et al. ..... 166/64
2003/0196801 A1 10/2003 Vinegar et al. ..... 166/263
2003/0196810 A1 10/2003 Vinegar et al. ..... 166/300
2003/0201098 A1 10/2003 Karanikas et al. ..... 166/53
2003/0205378 A1 11/2003 Wellington et al. ..... 166/302
2003/0209348 A1 11/2003 Ward et al. ..... 166/256
2003/0213594 A1 11/2003 Wellington et al. ..... 166/272.1
2004/0015023 A1 1/2004 Wellington et al. ..... 585/1
2004/0016676 A1 1/2004 Newton ..... 208/113
2004/0020642 A1 2/2004 Vinegar et al. ..... 166/245
2004/0031731 A1 2/2004 Honeycutt et al. ..... 208/402
2004/0040715 A1 3/2004 Wellington et al. ..... 166/302
2004/0069486 A1 4/2004 Vinegar et al. ..... 166/245
2004/0070257 A1 4/2004 Drake et al. ..... 299/11
2004/0108111 A1 6/2004 Vinegar et al. ..... 166/257
2004/0137181 A1 7/2004 Ruid et al. ..... 428/36.91
2004/0149433 A1 8/2004 McQueen ..... 166/249
2004/0211554 A1 10/2004 Vinegar et al. ..... 166/60
2004/0211557 A1 10/2004 Cole et al. ..... 166/242.1
2004/0211569 A1 10/2004 Vinegar et al. ..... 166/380
2005/0092483 A1 5/2005 Vinegar et al. ..... 166/60
2005/0092715 A1 5/2005 Alford et al. ..... 219/61.2
2005/0252656 A1 11/2005 Maguire ..... 166/256
2005/0252832 A1 11/2005 Doyle et al. ..... 208/390
2005/0252833 A1 11/2005 Doyle et al. ..... 208/390
2006/0004236 A1 1/2006 Barvincak ..... 585/240

OTHER PUBLICATIONS

Received Office Action from USPTO, U.S. Appl. No. 12/105,236, Jan. 24, 2011.
International Search Report, PCT/US 08/60700, Jul. 23, 2008.
International Search Report, PCT/US06/36026, Received Mar. 28, 2007.
Office Action from USPTO, U.S. Appl. No. 11/531,694, Received Oct. 6, 2008.
Office Action from USPTO, U.S. Appl. No. 11/531,694, Received Apr. 13, 2009.
Final Office Action from USPTO, U.S. Appl. No. 11/531,694, Received Oct. 27, 2009.
International Search Report, PCT/US07/74372, Received Jan. 9, 2008.
Office Action Received from the USPTO, U.S. Appl. No. 11/531,694, Sep. 28, 2011.
Office Action received from the USPTO, U.S. Appl. No. 12/105,236, Nov. 2, 2011.

* cited by examiner

Table 1: Fuel-to-air ratio for various natural gas compositions.

| methane (mol%) | ethane (mol%) | propane (mol%) | butane (mol%) | total (mol%) | fuel-air ratio (mol/mol) |
|---|---|---|---|---|---|
| 100% | 0% | 0% | 0% | 100% | 0.50 |
| 0% | 100% | 0% | 0% | 100% | 0.29 |
| 0% | 0% | 100% | 0% | 100% | 0.20 |
| 0% | 0% | 0% | 100% | 100% | 0.15 |
| 96% | 2% | 2% | 0% | 100% | 0.49 |
| 94% | 3% | 2% | 1% | 100% | 0.48 |
| 92% | 4% | 2% | 2% | 100% | 0.48 |
| 90% | 5% | 3% | 2% | 100% | 0.47 |
| 90% | 6% | 2% | 2% | 100% | 0.47 |

Fig. 7

APPARATUS, SYSTEM, AND METHOD FOR IN-SITU EXTRACTION OF HYDROCARBONS

CROSS-REFERENCES TO RELATED APPLICATIONS

This application claims the benefit of U.S. Provisional Patent Application No. 60/820,256 entitled "Apparatus, system, and method for in-situ extraction of oil from oil shale" and filed on Jul. 25, 2006 for Kevin Shurtleff, which is incorporated herein by reference.

BACKGROUND OF THE INVENTION

1. Field of the Invention

This invention relates to the recovery of oil from hydrocarbon reservoirs, and particularly relates to in-situ recovery of heavy hydrocarbons such as kerogen from oil shale and residual hydrocarbon from conventional oil wells after primary recovery.

2. Description of Related Art

Many hydrocarbon bearing formations do not flow hydrocarbons freely to the wellbore for extraction because of the high viscosity and/or solid state of the hydrocarbons. For example, kerogen in an oil shale is a high molecular weight hydrocarbon requiring temperatures over 300 degrees C. before it will break down and separate from the formation rock. In conventional oil wells, the primary recovery of hydrocarbons varies considerably, but typically about 30% of the hydrocarbons will be removed after the well stops producing economically. The remaining hydrocarbons are higher viscosity and/or higher molecular weight components of the original hydrocarbons, that will not flow into the wellbore for recovery after the primary oil recovery. In some conventional oil wells, a significant fraction including all of the oil may be heavy oil that will not flow freely to the wellbore without temperature and/or chemical intervention. In tar sands, the naturally occurring hydrocarbons do not flow freely to a wellbore.

For oil shales, current technologies include freezing pockets of the formation, and heating the formation within each pocket to recover kerogen from the formation. Such processes are energy intensive and require the drilling of multiple wells to recover kerogen from a relatively small section of the formation. An alternate oil shale process includes circulating heated combustion gas in a formation, but these processes introduce carbon dioxide into the formation that must be separated from any produced fluids, and are designed to work in water-free environments.

Oil shales and tar sands may also be recovered through bulk strip mining. The bulk material is mined out of the ground, and various surface processes can be utilized to strip any hydrocarbons from the bulk. Other mining techniques are possible, and such techniques inherently leave more of the hydrocarbons unrecovered than strip mining. Any of the mining processes introduce a number of environmental issues, including disposal of solvents, recovery of the mined land, and disposal of the shale remainder after the bulk of the hydrocarbons are removed.

For secondary recovery of oil wells and for oil wells with inherently heavy oil, several processes are available in the current technology. Some wells may be flushed with viscous fluids such as polymer based gels that rinse remaining oil from an injection well to an extraction well. The flushing process is expensive because of the fluid costs, and can only recover fluids that are essentially low viscosity although perhaps a bit higher viscosity than the oil recovered in the primary recovery. The flushing process is also subject to channeling between wells which can prevent full recovery of oil; channeling can be mitigated with fluid loss additives but these introduce damage into the formation. Further, some formations are sensitive to the introduction of water (e.g. formations with a high clay content) and therefore the flushing process is either ineffective or requires expensive anti-swelling additives to the fluid.

Secondary oil recovery has also been attempted with low-grade burning in the formation. The flame front in the formation reduces the viscosity of the remaining oil and drives the oil to an extraction well. The flame recovery process is difficult to initiate and control, it inherently consumes some of the oil in the formation, and it introduces combustion byproducts into the final produced fluids.

The processes in the current technology produce final products that have high molecular weight hydrocarbons. Low to middle weight hydrocarbon products (e.g. five to twelve carbons per molecule) are inherently more commercially valuable than heavy hydrocarbons. Some processes use a portion of the recovered hydrocarbons in the extraction process, for example burning them to heat some aspect of the recovery system. Further, as the recovery process proceeds, the molecular composition of the produced gas changes, often with lighter molecules recovered earlier and heavier molecules recovered later. Whether the produced fluids are burned or utilized as a product for sale, the changing of the molecular composition of the produced fluids introduces complications that must be managed.

SUMMARY OF THE INVENTION

From the foregoing, the Applicant asserts that a need exists for a system, method, and apparatus for extracting hydrocarbons in-situ. Beneficially, the system, method, and apparatus would support removal of hydrocarbons that do not flow to the wellbore, would be robust to the presence of water in the formation, and would further be robust to changes in the recovered hydrocarbon molecular weights over time. Further benefits of the system, method, and apparatus may include utilizing a process that does not introduce water or combustion byproducts into the formation or the produced fluids.

The present invention has been developed in response to the present state of the art, and in particular, in response to the problems and needs in the art that have not yet been fully solved by currently available oil shale and secondary recovery systems. Accordingly, the present invention has been developed to provide an apparatus, system, and method for extracting hydrocarbons in-situ that overcome many or all of the above-discussed shortcomings in the art.

An apparatus is disclosed for extracting hydrocarbons in-situ. The apparatus includes a completion unit that positions an injection tube near a fluid injection point substantially at the bottom of a target zone of a hydrocarbon-bearing formation, and that positions a production tube near a fluid production point substantially at the top of the target zone. The apparatus further includes an isolation unit that isolates the fluid injection point from fluid communication with the fluid production point such that fluid flowing from the fluid injection point to the fluid production point flows through the target zone and a heat source. The apparatus further includes an injection unit that injects a thermal conduit fluid into the fluid injection point at an injection pressure selected to displace fluids within the target zone and a heat exchanger that transfers thermal energy from the heat source to the thermal conduit fluid such that the thermal conduit fluid is injected at a temperature sufficient to entrain hydrocarbons from the target zone, thereby generating a production fluid; and a production unit that returns the production fluid to a surface location through the fluid production point.

In one embodiment, the heat source comprises a combustion reaction in a burner disposed within a wellbore, wherein the heat exchanger is disposed within the wellbore. The heat exchanger transfers heat from the combustion reaction to the thermal conduit fluid and prevents combustion products from mixing with the thermal conduit fluid. In one embodiment, the heat source comprises a combustion reaction in a burner, wherein the heat exchanger transfers heat from the combustion reaction to the thermal conduit fluid and prevents combustion products from mixing with the thermal conduit fluid, and wherein the injection tube further comprises an insulating layer. The injection tube may be concentric coiled tubing, vacuum insulated tubing (VIT), insulated tubing, or concentric tubing.

In one embodiment, the heat source includes a combustion reaction, and the apparatus includes a mixer that mixes an air fraction and a fuel fraction to create a combustion mixture, and a burner that burns the combustion mixture. The fuel fraction comprises a fuel flow and fuel composition, wherein the air fraction comprises an air flow and air composition. The apparatus further includes an operating conditions module that interprets the air composition and the fuel composition. In one embodiment, the apparatus further includes an air-fuel module that modulates the air flow and the fuel flow based on a heat requirement and the fuel composition. The air-fuel module may further modulate the air flow based on a heat requirement, and modulate the fuel flow such that the combustion mixture has at least as much air as a stoichiometric mixture. The isolation unit may include a packer configured to prevent the thermal conduit fluid from traveling up a backside of the injection tube.

A method is disclosed for extracting hydrocarbons in-situ. The method includes positioning an injection tube near a fluid injection point substantially at the bottom of a target zone of a hydrocarbon-bearing formation and positioning a production tube near a fluid production point substantially at the top of the target zone. The method further includes isolating the fluid injection point from fluid communication with the fluid production point such that fluid flowing from the fluid injection point to the fluid production point flows through the target zone and producing hydrocarbons from the target zone by. Producing hydrocarbons from the target zone includes providing at least one heat source, injecting a thermal conduit fluid into the fluid injection point at a pressure selected to displace fluids within the target zone, wherein the thermal conduit fluid conducts thermal energy from the heat source to the target zone such that the thermal conduit fluid entrains hydrocarbons from the target zone to generate a production fluid, and receiving the production fluid at the fluid production point.

In one embodiment, the at least one heat source includes at least one of a combustion reaction and a solar concentrator. In one embodiment, heat source includes a combustion reaction, and the method further includes mixing a fuel fraction and an air fraction to create a combustion mixture, and burning the combustion mixture to produce the combustion reaction. The thermal conduit fluid receives thermal energy from the combustion reaction without mixing with combustion products from the combustion reaction. In one embodiment, the heat source includes a combustion reaction, and the method further includes mixing a fuel fraction and an air fraction to create a combustion mixture and burning the combustion mixture to produce the combustion reaction. In one embodiment, the method includes diverting a portion of the production fluid into the fuel fraction of the combustion mixture.

In one embodiment, the fuel fraction comprises a fuel composition and a fuel flow, the air fraction comprises an air composition and an air flow, and the method further includes modulating the air flow and the fuel flow based on a heat requirement and the fuel composition. In one embodiment, modulating the air flow and the fuel flow comprises modulating the air flow and the fuel flow such that the combustion mixture approximates a stoichiometric mixture. In an alternate embodiment, the method includes modulating the air flow based on the heat requirement, and modulating the fuel flow such that the combustion mixture approximates a stoichiometric mixture. In an alternate embodiment, the method includes modulating the air flow and the fuel flow such that the combustion mixture approximates a mixture having between about 1 and about 1.05 times a stoichiometric amount of air.

In one embodiment, the hydrocarbon-bearing formation comprises an oil-bearing formation, and the method includes a secondary recovery operation on the oil-bearing formation. In one embodiment, the hydrocarbon-bearing formation includes one of an oil shale formation and a tar sand formation. In one embodiment, the method includes adjusting a catalyst target temperature based on a composition of the production fluid, heating the production fluid to the catalyst target temperature, and treating the production fluid in a catalytic reactor to reduce an average molecular weight of the production fluid. The method may further include stripping at least one impurity from the production fluid before treating the production fluid in the catalytic reactor.

In one embodiment, the method includes adding natural gas to the production fluid before treating the production fluid in the catalytic reactor. Adding natural gas to the production fluid may include calculating a free hydrogen target value based on the composition of the production fluid, and adding a calculated quantity of natural gas to the production fluid to achieve the free hydrogen target value for the production fluid. In one embodiment, a hydrocarbon in the hydrocarbon-bearing formation comprises an oil, wherein the thermal conduit fluid entrains the oil by vaporizing the oil into the production fluid, and receiving the production fluid further includes condensing the oil from the production fluid back to liquid oil at a surface location.

The at least one well may be a single vertical well, wherein the target zone comprises a first target zone, and the method further includes plugging the well above the first target zone, positioning the injection tube near a second fluid injection point substantially at the bottom of a second target zone, positioning the production tube near a second fluid production point substantially at the top of the second target zone, isolating the second fluid injection point from fluid communication with the second fluid production point within the wellbore, and producing hydrocarbons from the second target zone. The at least one well may be a first horizontal well segment and a second horizontal well segment, wherein the fluid production point is disposed within the first horizontal well segment and the fluid injection point is disposed within a second horizontal well segment, and wherein the target zone comprises a first target zone.

The method further includes plugging the first horizontal well segment and the second horizontal well segment such that injected fluid into each horizontal well segment does not enter the first target zone, positioning the injection tube near a second fluid injection point substantially at the bottom of a second target zone, positioning the production tube near a second fluid production point substantially at the top of the second target zone, isolating the second fluid injection point from fluid communication with the second fluid production point within the wellbore, and producing hydrocarbons from the second target zone.

In one embodiment, the method further includes stimulating the target zone to create at least one stimulated region that improves fluid communication between the fluid injection point and the target zone but does not provide a stimulated flowpath through the target zone connecting the fluid injection point and the fluid production point. Stimulating the target zone may include detonating an explosive. In one embodiment, the heat source comprises an offset well, and the thermal conduit fluid conducts heat from the at least one heat source to the target zone by the thermal conduit fluid circulating through a high temperature zone in the offset well.

A system for extracting hydrocarbons in-situ is disclosed. The system includes at least one well drilled through a hydrocarbon-bearing formation, a completion unit configured to position an injection tube near a fluid injection point substantially at the bottom of a target zone of the hydrocarbon-bearing formation, and to position a production tube near a fluid production point substantially at the top of the target zone. The system further includes an isolation unit that isolates the fluid injection point from fluid communication with the fluid production point such that fluid flowing from the fluid injection point to the fluid production point flows through the target zone, a heat source, and an injection unit that injects a thermal conduit fluid into the fluid injection point at an injection pressure selected to displace fluids within the target zone. The system further includes a heat exchanger that transfers thermal energy from the heat source to the thermal conduit fluid such that the thermal conduit fluid is injected at a temperature sufficient to entrain hydrocarbons from the target zone, thereby generating a production fluid, and a production unit that returns the production fluid to a surface location through the fluid production point.

In one embodiment, the system includes a reactor conditions module that interprets a composition of the production fluid and adjusts a catalyst target temperature based on the composition of the production fluid. The system further includes a product heat exchanger that heats the production fluid to the catalyst target temperature, and a catalytic reactor that treats the production fluid, thereby reducing an average molecular weight of the production fluid. In one embodiment, the reactor conditions module calculates a free hydrogen target value, and the system further includes a natural gas supply that adds natural gas to the production fluid based on the free hydrogen target value and the composition of the production fluid.

In one embodiment, the hydrocarbon-bearing formation comprises an oil, the thermal conduit fluid entrains the hydrocarbons by vaporizing the oil into the production fluid, and the system includes a condenser that condenses the oil from the production fluid back to liquid oil at a surface location. In one embodiment, the hydrocarbon-bearing formation includes at least one of the following hydrocarbons: kerogen in an oil shale, hydrocarbons remaining after a primary oil recovery, hydrocarbons in a tar sand, and heavy oil. In one embodiment, the fluid production point is substantially vertically above the fluid injection point, and wherein the at least one well comprises a vertical well. In an alternate embodiment, the fluid production point is substantially vertically above the fluid injection point, the fluid production point is disposed within a first horizontal well segment and the fluid injection point is disposed within a second horizontal well segment.

BRIEF DESCRIPTION OF THE DRAWINGS

FIG. 7 is an illustration of a plurality of stoichiometric air-fuel ratios based on a composition of a fuel fraction in accordance with the present invention;

DETAILED DESCRIPTION OF THE INVENTION

It will be readily understood that the components of the present invention, as generally described and illustrated in the figures herein, may be arranged and designed in a wide variety of different configurations. Thus, the following more detailed description of the embodiments of the apparatus, system, and method of the present invention, as presented in FIGS. 1 through 14, is not intended to limit the scope of the invention, as claimed, but is merely representative of selected embodiments of the invention. Some aspects of the present invention may be clearly understood in light of U.S. patent application Ser. No. 11/531,694 published as U.S. Patent Application Publication No. 2007-0056726 to J. Kevin Shurtleff entitled "Apparatus, system, and method for in-situ extraction of oil from oil shale" filed on Sep. 13, 2006, and incorporated herein by reference.

Figure 1:
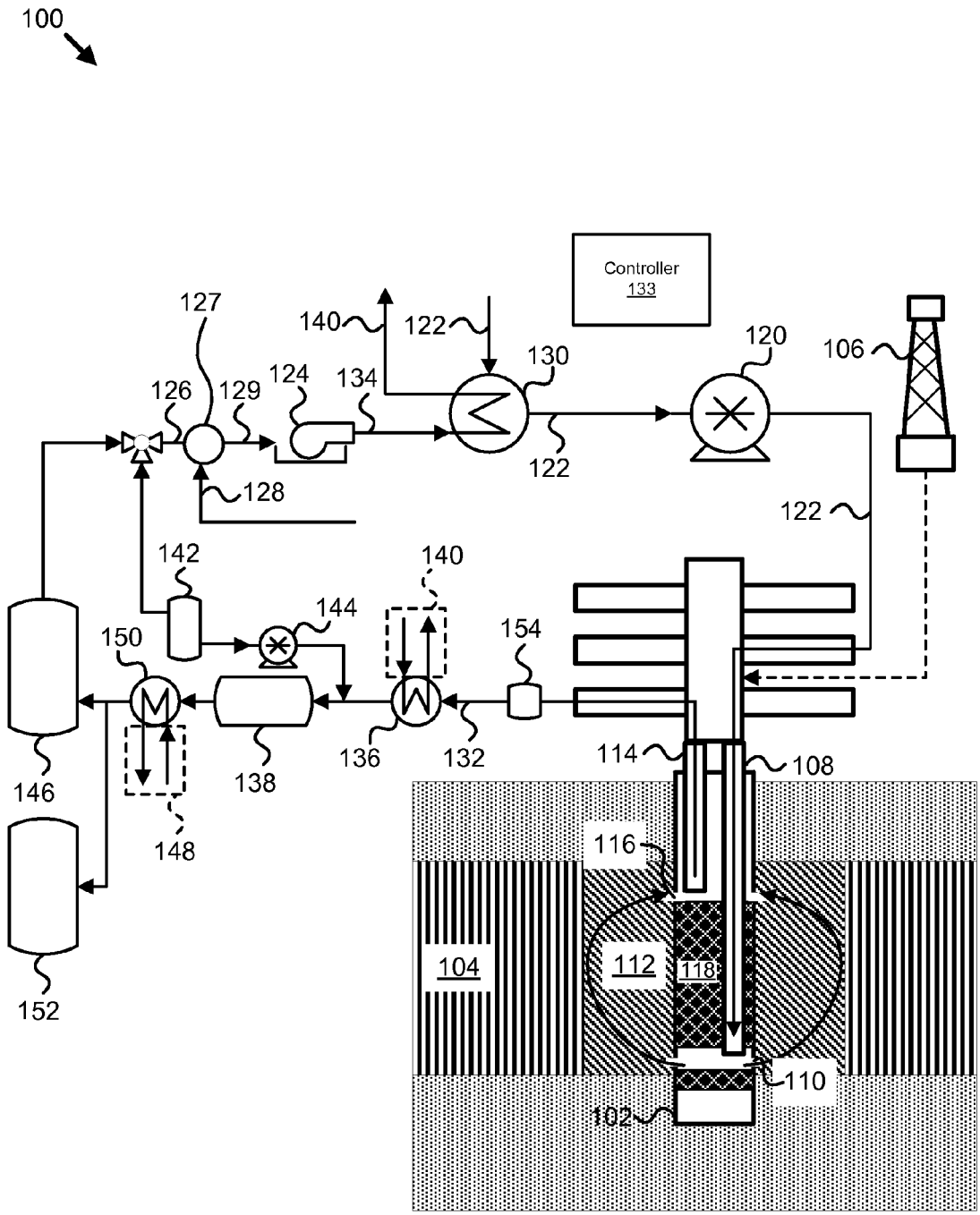
FIG. 1 is a schematic block diagram depicting one embodiment of a system for extracting hydrocarbons in-situ in accordance with the present invention.

FIG. 1 is a schematic block diagram depicting one embodiment of a system 100 for extracting hydrocarbons in-situ in accordance with the present invention. The system 100 includes at least one well 102 drilled through a hydrocarbon-bearing formation 104. The hydrocarbon-bearing formation 104 may be an oil shale, a conventional oil formation that has been produced with a primary recovery operation, a conventional oil formation with high molecular weight oil, a tar sand formation, and the like. The well 102 may be an open hole or cased hole completion.

The system 100 further includes a completion unit 106 that positions an injection tube 108 near a fluid injection point 110 substantially at the bottom of a target zone 112 of the hydrocarbon-bearing formation 104, and that positions a production tube 114 near a fluid production point 116 substantially at the top of the target zone 112. The fluid injection point 110 and the fluid production point 116 may be an open hole segment of the well 102, perforations through a well casing and cement layer, and/or other fluid communication between the well 102 and the target zone 112 as understood in the art. The completion unit 106 may be a drilling rig, a completion rig, a coiled tubing unit, and/or other similar unit understood in the art. In one embodiment, the fluid production point 116 is substantially vertically above the fluid injection point 110, and the well 102 is a vertical well.

A height considered substantially at the bottom and/or top of the target zone 112 is dependent upon the specific application of the system 100, the thickness of the target zone 112, the diameter of the well 102, and the like. In almost any application, any placement of the fluid injection point 110 within a few feet of the bottom of the target zone 112 and placement of the fluid production point 116 within a few feet of the top of the target zone 112 comprises substantially near the bottom and/or top of the target zone 112. In some cases, for example, if the target zone 112 is thick, a placement of the fluid injection point 110 and the fluid production point 116 within ten feet or more of the top and/or bottom of the target zone 112 may comprise substantially at the top and/or bottom of the target zone 112. In one embodiment, the target zone 112 comprises only a portion of the hydrocarbon-bearing formation 104, and the bottom of the target zone 112 and the top of the target zone 112 are defined by the location of the fluid injection point 110 and the fluid production point 116, respectively.

The system 100 further includes an isolation unit 118 that isolates the fluid injection point 110 from fluid communication with the fluid production point 116 such that fluid flowing from the fluid injection point 110 to the fluid production point 116 flows through the target zone 112. The isolation unit 118 may be a packer in a cased well 102, a pair of packers in an open-hole well 102, and/or a cement plug. Any isolation unit 118 that prevents fluid from communicating within the wellbore 102 and forces fluid to travel through the target zone 112 from the fluid injection point 110 to the fluid production point 116 is contemplated within the scope of the present invention.

The system 100 further includes a heat source 124, which may be a burner 124 that burns a combustion mixture 129 to produce a combustion reaction. A mixer 127 creates the combustion mixture 129 by mixing a fuel fraction 126 and an air fraction 128. The system 100 further includes a heat exchanger 130 that transfers thermal energy from the combustion reaction to a thermal conduit fluid 122 such that the thermal conduit fluid 122 is injected at a temperature sufficient to entrain hydrocarbons from the target zone 112 and thereby create a production fluid 132. In one embodiment, the heat exchanger 130 transfers thermal energy from the combustion reaction to the thermal conduit fluid 122 without mixing combustion products 134 into the thermal conduit fluid 122. The combustion products 134 may be vented to the atmosphere, and may be scrubbed for impurities and the like before venting. In one embodiment, transferring thermal energy from the combustion reaction to the thermal conduit fluid 122 such that the thermal conduit fluid 122 is injected at a temperature sufficient to entrain hydrocarbons from the target zone 112 includes: determining a required injection temperature to entrain hydrocarbons based on the hydrocarbon type (e.g. typical kerogen requires 300° F.) and determining a temperature at the heat exchanger 130 required to achieve the required injection temperature.

In one embodiment, the injection tube 108 comprises an insulating layer to prevent excess heat loss during injection of the thermal conduit fluid 122. The injection tube 108 may be concentric coiled tubing, vacuum insulated tubing, insulated tubing, and/or concentric tubing. Concentric tubing may be a "tube within a tube" and may have spacers to prevent an inner tube from contacting the outer tube and decreasing insulation efficiency. In an alternate embodiment, the heat exchanger 130 is disposed within the wellbore 102 and the heat exchanger 130 transfers heat to the thermal conduit fluid 122 and prevents combustion products from mixing with the thermal conduit fluid 122 (Refer to the section referencing FIG. 4).

The system 100 further includes an injection unit 120 that injects the thermal conduit fluid 122 into the fluid injection point 110 at an injection pressure selected to displace fluids within the target zone 112. The injection pressure may be a value above a formation fluid pressure and below a formation fracture pressure. The injection unit 120 may continuously apply the injection pressure to form a continuous gas bubble from the fluid injection point 110 to the fluid production point 116 that prevents formation fluids from migrating back into the target zone 112 from the surrounding hydrocarbon-bearing formation 104.

The system 100 further includes a production unit (not shown) that returns the production fluid 132 to a surface location through the fluid production point 116. The production unit may comprise a valve on the production fluid 132 line, a pump that brings oil or production fluid 132 from the fluid production point 116, and/or other fluid-raising technologies understood in the art. Various production units to raise wellbore fluids to the surface are known in the art, and the production unit is not shown in FIG. 1 to avoid obscuring aspects of the present invention.

The system 100 further includes a controller 133 having a reactor conditions module (illustrated in FIG. 2) that interprets a composition of the production fluid 132 and adjusts a target temperature based on the composition of the production fluid 132. A product heat exchanger 136 heats the production fluid 132 to a target temperature, and a catalytic reactor 138 treats the production fluid 132, thereby reducing the average molecular weight of the production fluid 132. The product heat exchanger 136 in one embodiment receives a heat stream 140 from the system 100. The heat stream 140 may be from any thermal energy source, including a steam inlet, a heated combustion gas inlet, and/or heat from a solar concentrator.

In one embodiment, the reactor conditions module interprets a composition of the production fluid 132 and adjusts a target temperature based on the composition of the production fluid 132. The product heat exchanger 136 cools the production fluid 132 to the target temperature, thereby condensing a heavy oil fraction of the production fluid 132. The system 100 may include more than one product heat exchanger 136 and the reactor conditions module may adjust more than one target temperature based on the composition of the production fluid 132. For example, the reactor conditions module may adjust a first target temperature to a low value to condense heavy oil from the production fluid 132, and adjust a second target temperature to a high value to reduce the average molecular weight of the remaining production fluid 132 in the catalytic reactor 138.

The reactor conditions module may further calculate a free hydrogen target value. In one embodiment, the system 100 further includes a natural gas supply 142 that adds natural gas to the production fluid 132 based on the free hydrogen target value and the composition of the production fluid. The natural gas supply 142 may be pressurized, and/or a natural gas pump 144 may add the natural gas to the production fluid 132. In one embodiment, the free hydrogen target value is a value such that enough free hydrogen is added to the production fluid 132 to saturate substantially all of the hydrocarbons in the production fluid 132—i.e. to replace all double and/or triple bonds with straight chain hydrocarbons. In one embodiment, the final hydrogen/carbon ratio should be about 2.25:1 (e.g. as in $C_8H_{18}$), where the ratios of the production fluid 132 and natural gas supply 142 can be estimated readily based on the respective compositions. For example, if the production fluid 132 averages $C_{18}H_{27}$ and the natural gas supply 142 averages $C_{1.2}H_{4.4}$, the free hydrogen target value should be set such that approximately 8 moles of natural gas are added for each mole of production fluid 132. In one embodiment, the free hydrogen target value is calculated and a hydrogen supply (not shown) adds hydrogen gas ($H_2$), rather than natural gas, to the production fluid 132. The adjusted calculations for an embodiment utilizing hydrogen gas are a mechanical step for one of skill in the art.

The system 100 may include a scrubber 154 that strips at least one impurity from the production fluid 132 before treating the production fluid 132 in the catalytic reactor 138. Among the contaminants which may be present in the production fluid 132 are sulfur compounds, nitrogen compounds, and heavy metals or metalloids such as arsenic. The scrubber 154 may be positioned upstream or downstream of the product heat exchanger 136, although scrubbing before heating may lower the heat burden of the product heat exchanger 136. Various scrubbing systems are known in the art.

The treated production fluid 132 may be stored in a product storage 146. In one embodiment, the product storage 146 may be tapped to provide the fuel fraction 126. Alternatively, or in addition, the natural gas supply 142 may be tapped to provide the fuel fraction 126. In alternate embodiments, the burner 124 may receive the fuel fraction 126 from the product storage 146, from the natural gas supply 142, and/or from an alternate fuel source. In one embodiment, the heat exchanger 130 receives heat input from an alternate heat source 124 in addition to and/or in replacement of the burner 124. For example, a solar concentrator (not shown) may provide solar heating to the heat exchanger 130. In one embodiment, the thermal conduit fluid 122 may be supplied by the product storage 146 and/or the natural gas supply 142. In one embodiment, the thermal conduit fluid 122 may be circulated through a nearby formation to such that the nearby formation heats the thermal conduit fluid 122. The nearby formation may be a depleted formation within the same well 102 and/or in an offset well (not shown).

In one embodiment of the system 100, the hydrocarbon-bearing formation 104 is an oil formation. The thermal conduit fluid 122 entrains the hydrocarbons by vaporizing the oil into the production fluid 132. The system 100 further includes a condenser 150 that condenses the oil from the production fluid 132 back to liquid oil at the surface. The condenser 150 may have a cooling stream 148 such as cooling water. The oil fraction of the production fluid 132 may be stored in an oil storage 152, while the volatile fractions of the production fluid 132 may be stored in the product storage 146.

Figure 2:
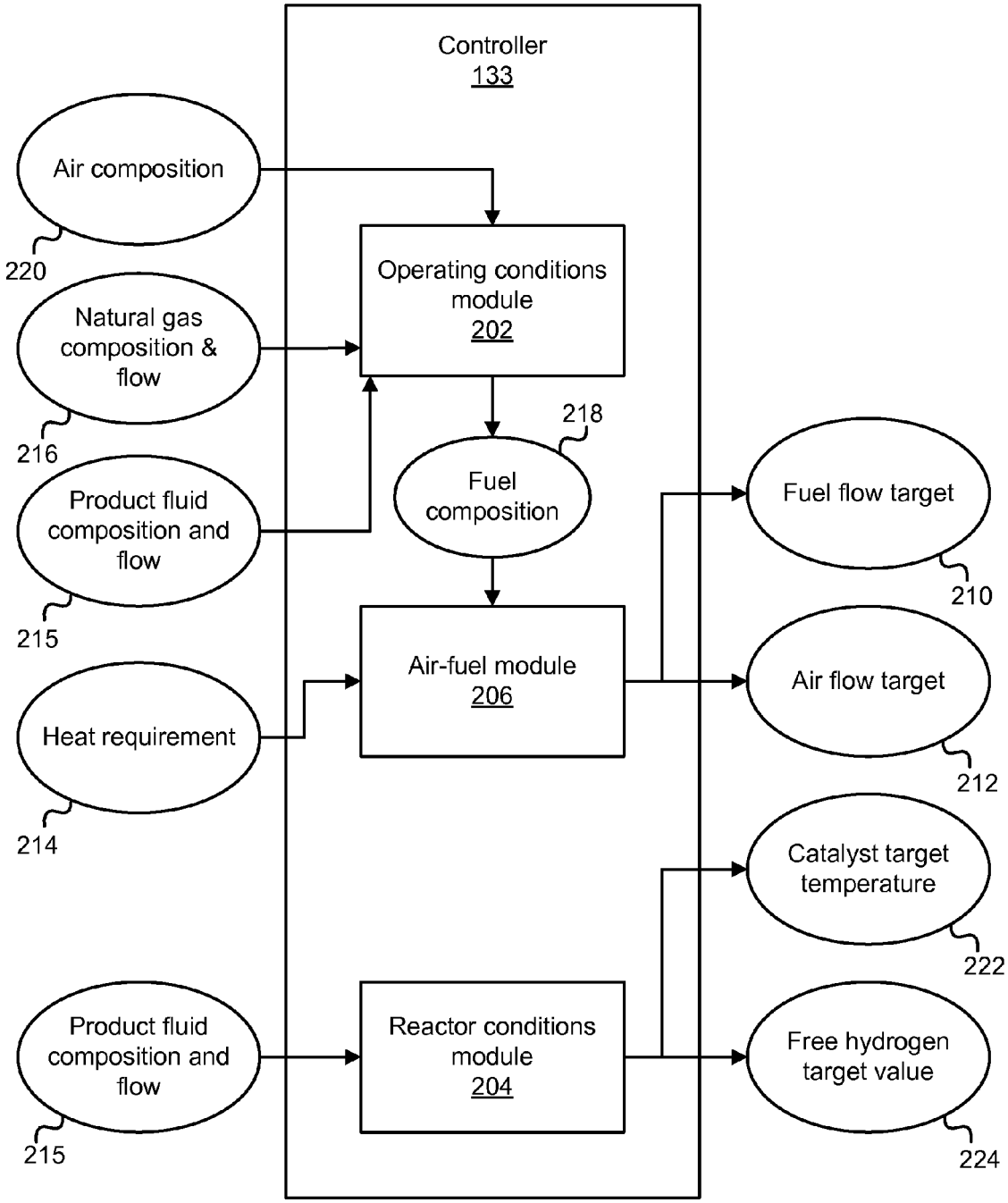
FIG. 2 is a schematic block diagram of a controller in accordance with the present invention.

FIG. 2 is a schematic block diagram of a controller 133 in accordance with the present invention. In one embodiment, the controller 133 includes a operating conditions module 202, a reactor conditions module 204, and an air-fuel module 206.

The operating conditions module 202 interprets the air composition 220 and the fuel composition 218. The operating conditions module 202 may interpret the fuel composition 218 based on a natural gas composition and flow 216 and the production fluid composition and flow 215. For example, a natural gas composition and flow 216 may be 30 units (e.g. hundred $ft^3$ at STP, etc.) comprising 90% $CH_4$ and 10% $C_2H_6$, the production fluid composition and flow 215 may be 70 units comprising 60% $CH_4$, 25% $C_2H_6$, 10% $C_3H_8$, and 5% $C_4H_{10}$. In the example, the operating conditions module 202 may determine a fuel composition 218 to be 69% $CH_4$, 20.5% $C_2H_6$, 7% $C_3H_8$, and 3.5% $C_4H_{10}$.

The air-fuel module 206 modulates the air flow and the fuel flow based on a heat requirement 214 and the fuel composition 218. The air-fuel module 206 may modulate the air flow and the fuel flow by setting an air flow target 212 and a fuel flow target 210. In one embodiment, the air-fuel module 206 further modulates the air flow based on the heat requirement 214, and modulates the fuel flow such that the combustion mixture 129 approximates a stoichiometric mixture. For example, if the heat requirement is 100 kJ, the air-fuel module 206 may set the air flow target 212 such that if a stoichiometric amount of fuel is burned with the air flow target 212, the heat requirement 214 is met. In the example, the air-fuel module 206 sets the fuel flow target 210 at the stoichiometric amount of fuel with the air flow target 212. The air-fuel module 206 may modulate the fuel flow such that the combustion mixture 129 has at least as much air as a stoichiometric mixture, and/or such that the combustion mixture 129 approximates a mixture having between 1 and 1.05 times a stoichiometric amount of air. For example, if the air flow target 212 is set to 1050 moles of air for a unit of time, and the stoichiometry indicates that 50 moles of air are required per mole of fuel, the air-fuel module 206 may set the fuel flow target 210 to a value of 21 moles per unit of time, to a value of at least 21 moles per unit of time (i.e. >=21 moles per unit of time), or to a value between about 20 moles and 21 moles per unit of time.

Achieving a specific air-fuel ratio, for example a stoichiometric ratio, may be based upon an estimated and/or measured fuel composition 218. For example, where the fuel fraction composition 208 is well understood to remain within 80% to 100% methane, an air-fuel ratio between about 9.5 and 11.2 mol air/mol fuel approximates a stoichiometric ratio. The product fluid composition 215 may be based upon knowledge of the produced fluids in the geographical region, upon periodic tests performed upon the production fluid 132 and made accessible as data to the controller 133, and/or through the use of a composition sensor such as a gas chromatography sensor and/or fluid density sensor on the production fluid 132. Similarly, the composition of the natural gas supply 142 may be based upon information provided by a utility provider, periodic testing, and the like. In one embodiment, an oxygen sensor installed on the combustion products 134 stream determines whether the combustion is near stoichiometric. In one embodiment, the controller 133 commands actuators (not shown) to achieve the fuel flow target 210 and the air flow target 212.

One of skill in the art will recognize that the operations of the air-fuel module 206 and the operating conditions module 202 may be iterative, and implementing an iterative solution for the fuel flow target 210 and air flow target 212 is a mechanical step for one of skill in the art. For example, the operating conditions module 202 may calculate a fuel composition 218 based on the natural gas composition and flow 216 and the product fluid composition and flow 215, while the air-fuel module 206 calculates an air flow target 212 based on the heat requirement 214 and a fuel flow target 210 such that the combustion mixture 129 approximates a stoichiometric mixture. In the example, if the heat requirement 214 increases—for example with a disturbance in the temperature of the inlet thermal conduit fluid 122—the production fluid amount 215 and/or the natural gas supply amount 216 increases thereby changing the fuel composition 218. Various solutions to the problem are readily apparent to one of skill in the art, including utilizing a fuel composition 218 for an earlier execution step of the controller 133 as an approximation. Typically, the execution steps of the controller 133, which may be a computer executing programming code on a computer readable medium, are fast relative to physical changes in the system 100 such as the variability in the fuel composition 218, such that the iterative nature of determining the fuel flow target 210 is reasonably ignored.

In one embodiment, the reactor conditions module 204 interprets a composition of the production fluid 215 and adjusts a catalyst target temperature 222 based on the composition of the production fluid. Interpreting the production fluid composition 215 may include reading a sensor value, reading a value from a data link or data location, reading an electronic value such as a voltage and interpreting a composition from the electronic value, and/or other production fluid composition 215 determination method understood in the art. The catalyst target temperature 222 may be adjusted based on an equilibrium chart developed according to expected and/or detected compositions of the production fluid 132 (Refer to the sections referencing FIGS. 8 and 9).

The reactor conditions module 204 may further calculate a free hydrogen target value 224 based on the composition of the production fluid 215. In one embodiment, a natural gas supply 142 adds natural gas to the production fluid 132 based on the free hydrogen target value 224 and the composition of the production fluid 215. In one embodiment, the free hydrogen target value 224 is a value such that enough free hydrogen is added to the production fluid 132 to saturate substantially all of the hydrocarbons in the production fluid 132—i.e. to replace all double and/or triple bonds with straight chain hydrocarbons. In one embodiment, the final hydrogen/carbon ratio should be about 2.25:1 (e.g. as in $C_8H_{18}$), where the ratios of the production fluid 132 and natural gas supply 142 can be estimated readily based on the respective compositions.

For example, if the production fluid 132 averages $C_{18}H_{27}$ and the natural gas supply 142 averages $C_{1.2}H_{4.4}$, the free hydrogen target value should be set such that approximately 8 moles of natural gas are added for each mole of production fluid 132. In one embodiment, the free hydrogen target value is calculated and a hydrogen supply (not shown) adds hydrogen gas ($H_2$) to the production fluid 132. In one embodiment, the reactor conditions module 204 calculates the free hydrogen target value 224 based on the composition of the production fluid 215 by selecting hydrogen target values 224 known to provide desirable end products from a catalytic reactor 138 according to an estimated and/or measured production fluid composition 215. The adjusted calculations for an embodiment adding hydrogen gas rather than natural gas 142 are a mechanical step for one of skill in the art.

Figure 3:
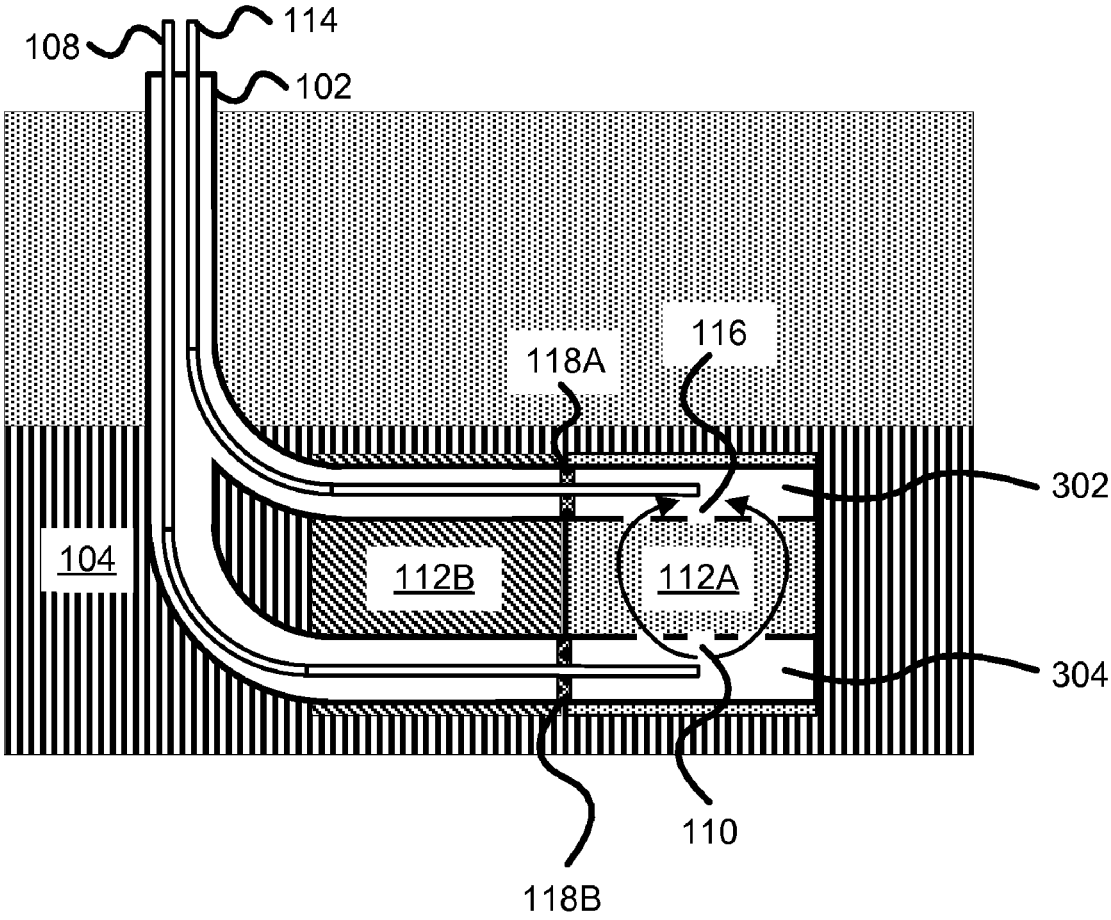
FIG. 3 is a schematic diagram depicting an isolation unit comprising a first and second horizontal well segment in accordance with the present invention.

FIG. 3 is a schematic diagram depicting an isolation unit 118A, 118B comprising a first horizontal well segment 302 and a second horizontal well segment 304 in accordance with the present invention. In one embodiment, the fluid production point 116 is substantially vertically above the fluid injection point 110. The fluid production point 116 is disposed within a first horizontal well segment 302, and the fluid injection point 110 is disposed within a second horizontal well segment 304. In the embodiment depicted in FIG. 3, the horizontal well segments 302, 304 are drilled off of the same well 102. However, the horizontal well segments 302, 304 may be drilled from separate wells 102.

The embodiment of FIG. 3 shows the fluid injection point 110 and the fluid production point 116 set to produce a first target zone 112A. In one embodiment, first target zone 112A may be plugged in the first horizontal well segment 302 and the second horizontal well segment 304 such that injected fluid into each horizontal well segment does not enter the first target zone 112A. The injection tube 108 may be positioned near a second fluid injection point substantially at the bottom of a second target zone 112B, and the production tube 114 may be positioned near a second fluid production point substantially at the top of the second target zone 112B. An isolation unit 118A, 118B may isolate the second fluid injection point from fluid communication with the second fluid production point within the wellbore 102, and hydrocarbons may then be produced from the second target zone 112B. In the described manner, multiple target zones 112 may be produced from the same wellbore 102 and/or from the same horizontal well segments 302, 304.

Figure 4:
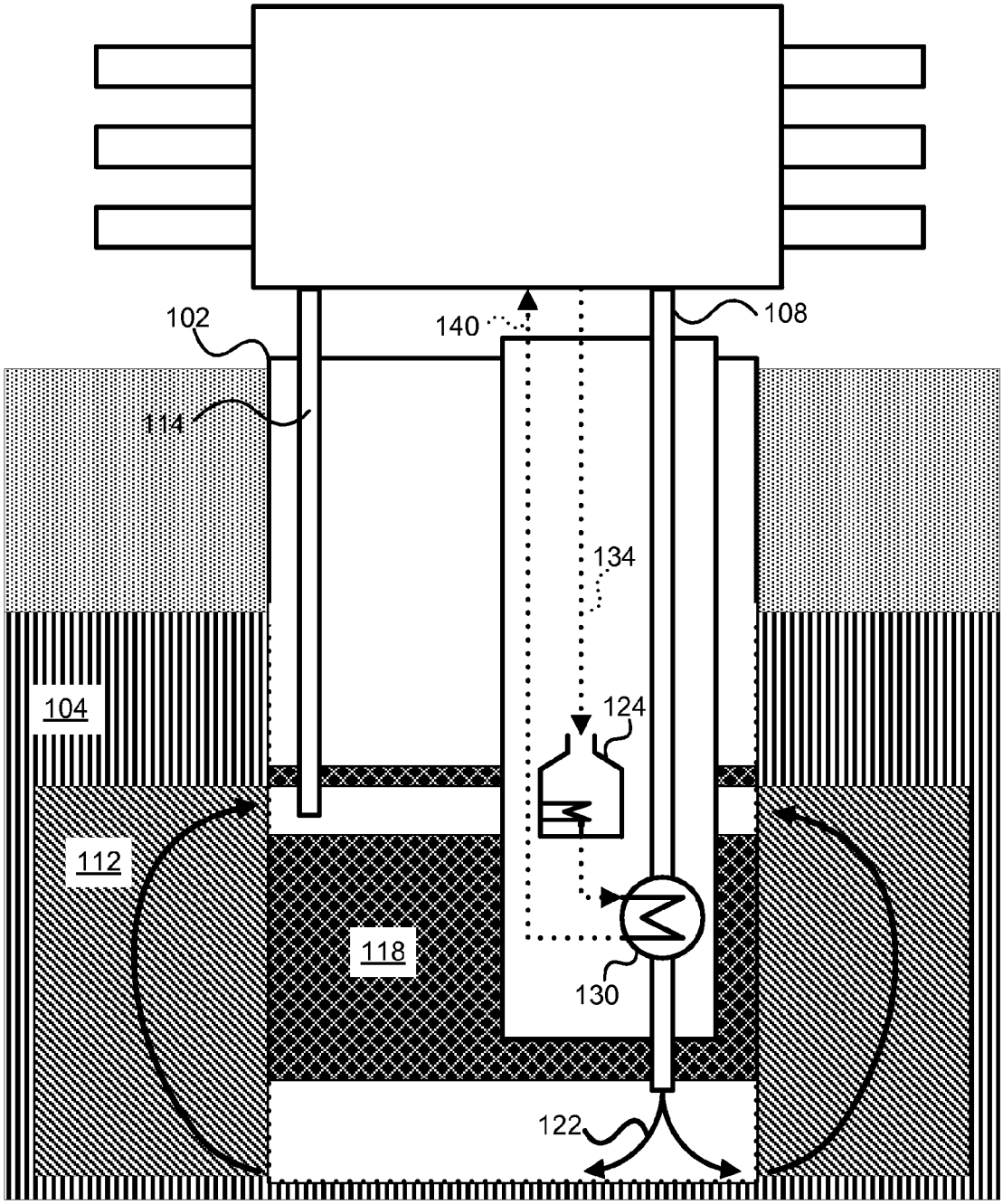
FIG. 4 is a schematic diagram depicting a downhole burner in accordance with the present invention.

FIG. 4 is a schematic diagram depicting a downhole burner 124 in accordance with the present invention. The downhole burner 124 depicted in FIG. 4 may be a part of a system 100 similar to that depicted in FIG. 1, wherein some of the parts of the system 100 are positioned as illustrated in FIG. 4. Notably, the burner 124 and heat exchanger 130 are depicted in the well 102. In one embodiment, the heat source 124 comprises a combustion reaction in a burner 124 disposed within a wellbore 102. The heat exchanger 130 is disposed within the wellbore 102, and the heat exchanger 130 transfers heat from the combustion reaction to the thermal conduit fluid 122 and prevents combustion products 134 from mixing with the thermal conduit fluid 122. The system 100 thereby heats the thermal conduit fluid 122 with minimal heat losses before the thermal conduit fluid 122 enters the target zone 112.

Figure 5:
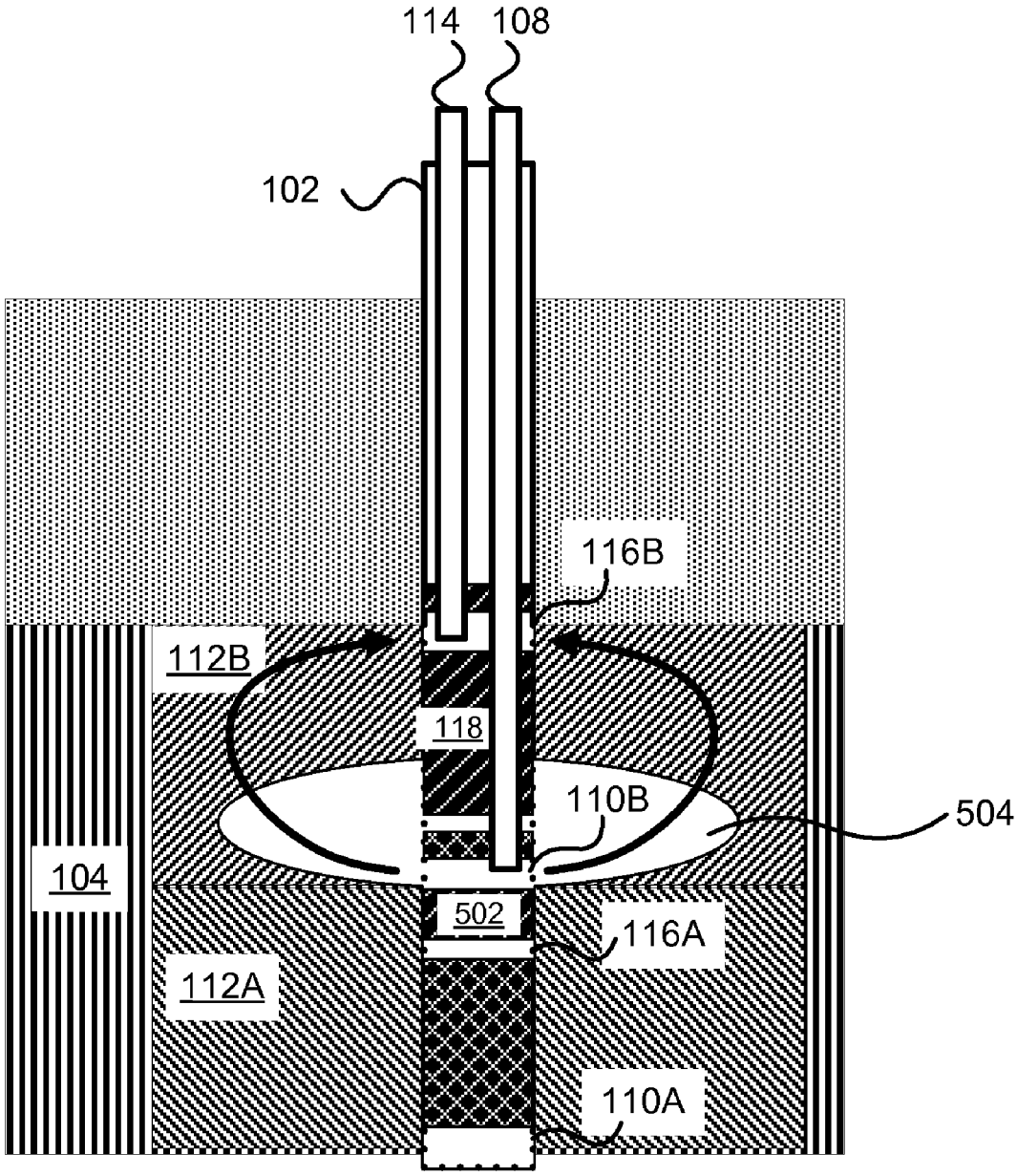
FIG. 5 is a schematic diagram depicting one embodiment of a first and second target zone in accordance with the present invention.

FIG. 5 is a schematic diagram depicting one embodiment of a first target zone 112A and second target zone 112B in accordance with the present invention. In one embodiment, the well 102 comprises a single vertical well 102, wherein the target zone 112A comprises a first target zone 112A. In one embodiment, after producing the hydrocarbons from the first target zone 112A, the well 102 is plugged 502 above the first target zone 112A. The injection tube 108 is positioned near a second fluid injection point 110B substantially at the bottom of a second target zone 112B, and the production tube 114 is positioned near a second fluid production point 116B substantially at the top of the second target zone 112B. An isolation unit 118 isolates the second fluid injection point 110B from fluid communication with the second fluid production point 116B within the wellbore 102, and a production unit produces hydrocarbons from the second target zone 112B. The embodiment of FIG. 5 may be a portion of a system 100 such as the system 100 depicted in FIG. 1.

In one embodiment, the second target zone 112B is stimulated to create at least one stimulated region 504 that improves fluid communication between the fluid injection point 110B and the target zone 112B, but does not provide a stimulated flowpath through the target zone 112B that connects the fluid injection point 110B and the fluid production point 116B. A stimulated region 504 is a region of the formation stimulated to create fissures, cracks, and/or wormholes within the formation. A stimulated flowpath (not shown) is a path that connects the fluid injection point 110B to the fluid production point 116B. Stimulated flowpaths are to be avoided to maximize effective use of thermal conduit fluid 122.

The stimulated region 504 may be a region 504 stimulated with an explosive. Other stimulation techniques understood in the art may be utilized, including acidizing treatments, hydraulic fracturing, and the like. It is a mechanical step for one of skill in the art to determine the vertical extent of a stimulation procedure and thereby avoid creating a stimulated flowpath through the target zone 112B between the fluid injection point 110B and the fluid production point 116B. The stimulated region 504 allows the injected thermal conduit fluid 122 to better penetrate the target zone 112B, and to better transfer heat to the hydrocarbons. A stimulated flowpath connecting the fluid injection point 110B and the fluid production point 116B, however, may create a short circuit path that reduces total hydrocarbon recovery from the target zone 112B as the thermal conduit fluid 122 is not forced out into the target zone 112B.

Figure 6:
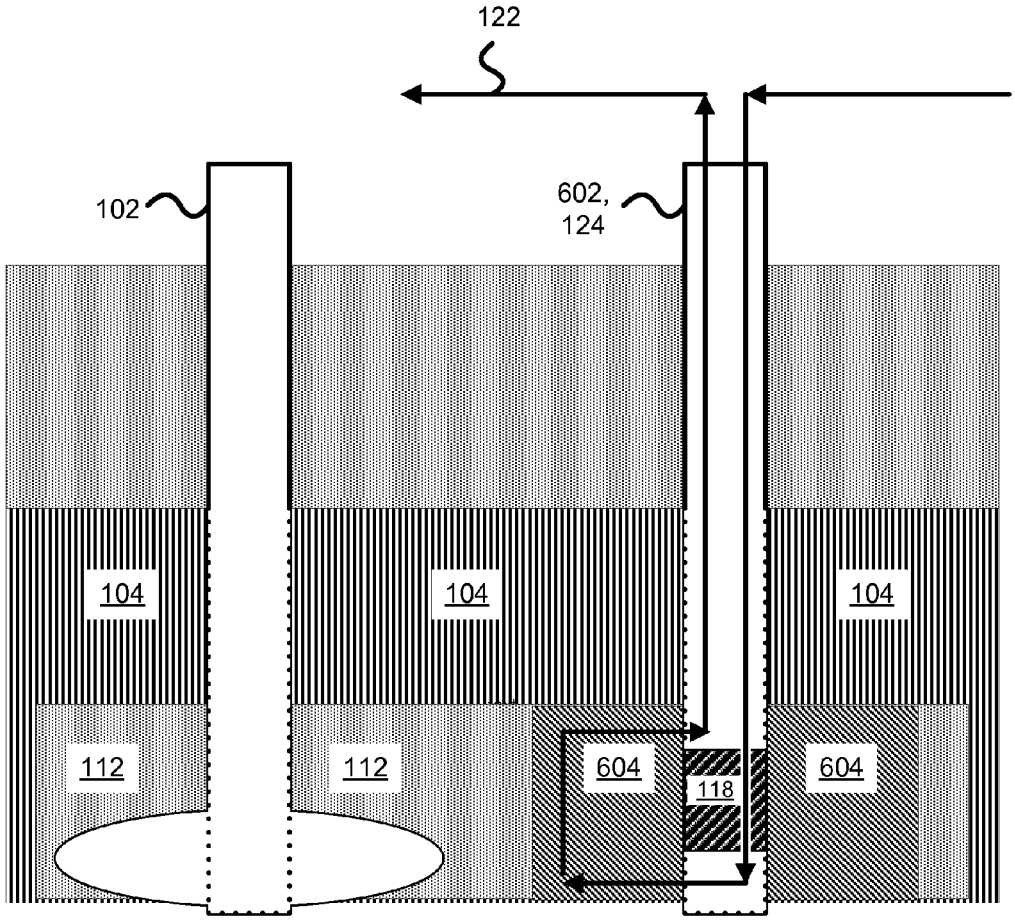
FIG. 6 is a schematic diagram depicting one embodiment of circulating a thermal conduit fluid through a high temperature zone in an offset well in accordance with the present invention.

FIG. 6 is a schematic diagram depicting one embodiment of circulating a thermal conduit fluid 122 through a high temperature zone 604 in an offset well 602 in accordance with the present invention. The high temperature zone 604 is also designated a depleted zone 604 once the high temperature zone 604 is substantially depleted of hydrocarbons. The at least one heat source 124 comprises an offset well 602, and the thermal conduit fluid 122 conducts heat from the at least one heat source 124 to the target zone 112 by the thermal conduit fluid 122 circulating through a high temperature zone 604 in the offset well 602. The system 100 may comprise a circulation unit (not shown) configured to circulate the fluid 122 through the offset well 602 near the production well 102. The offset well 602 may comprise a depleted zone 604, which may be a zone within a hydrocarbon-bearing formation 104 which may already be substantially depleted of hydrocarbons.

As used herein, offset indicates a well connected to a depleted zone 604 that is not the target zone 112 intended for production. The well connected to the target zone 112 may be called the producing well 102. The offset well may be an adjacent well 602 to the producing well, a well 602 completely across the field from the producing well, or a separate horizontal segment 302, 304 within the producing well 102, where the separate horizontal branch is in fluid communication with the depleted zone 604, but is fluidly isolated—except for the intended delivery of the heated fluid 122 from the injection unit 120—from the target zone 112.

After circulation through the offset well, the thermal conduit fluid 122 may then be further heated in the system 100 or injected by the injection unit 120. The base temperature in the formation 104 is often much higher than the ambient surface temperature, and a significant savings in thermal energy costs can be achieved through heating the fluid 122 according to the embodiment of FIG. 6.

FIG. 7 is an illustration of a plurality of stoichiometric air-fuel ratios based on a composition of a fuel fraction in accordance with the present invention. The stoichiometric air-fuel ratios such as those illustrated in FIG. 7 may be utilized by the air-fuel module 206 to calculate the fuel flow target 210 required to stoichiometrically burn the air flow target 212 amount of air. The data from a table such as that illustrated in FIG. 7 may be stored electronically on the controller 133 for access by the air-fuel module 206. The construction of a table such as that illustrated in FIG. 7 is a mechanical step for one of skill in the art based upon the specific hydrocarbons found in the hydrocarbon-bearing formation 104 and the natural gas supply 142.

Figure 8:
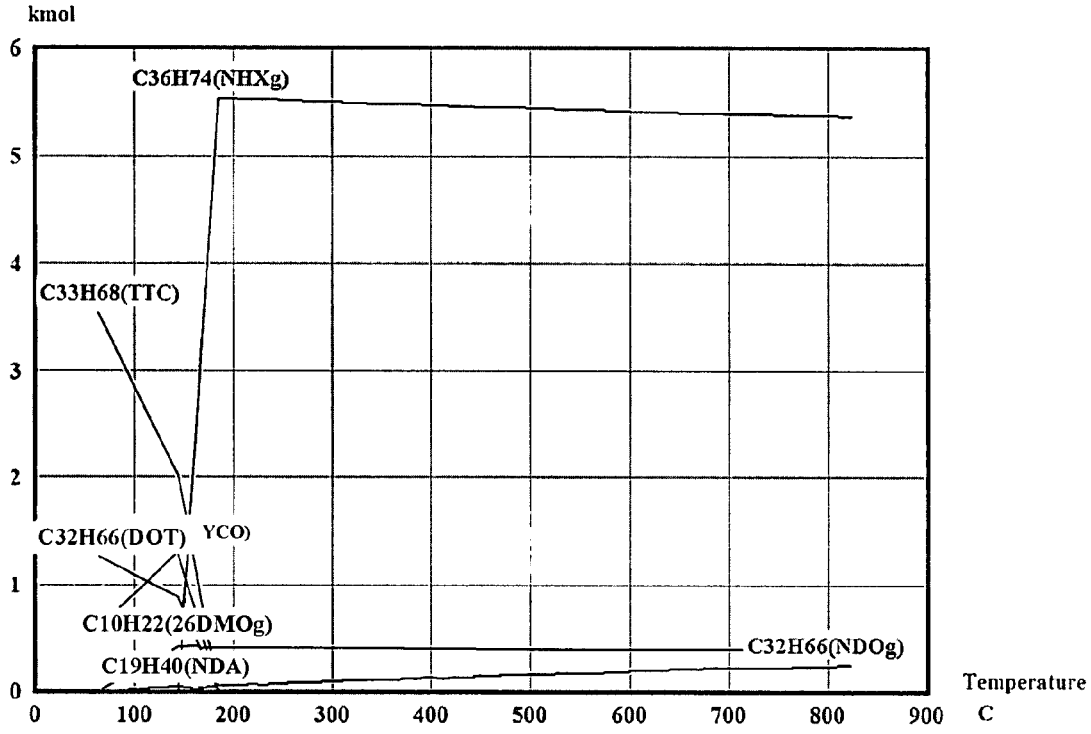
FIG. 8 is an illustration of a gas composition equilibrium diagram for a mixture of heavy hydrocarbons in accordance with the present invention.

FIG. 8 is an illustration of a gas composition equilibrium diagram for a mixture of heavy hydrocarbons in accordance with the present invention. As the illustration of FIG. 8 shows, heavy, long hydrocarbon chains are thermally favored in the absence of excess hydrogen. Therefore, merely heating the product gas and passing it across a catalyst may not generate commercially valuable short chain hydrocarbons. The data illustrated in FIG. 8 is for illustration purposes only and is based on a number of modeling assumptions that may not be true for a specific application of the present invention. The construction of an equilibrium diagram based on the observed hydrocarbons found in the hydrocarbon-bearing formation 104 and the natural gas supply 142, and further based on assumptions known to be valid for a specific embodiment of the system 100 is a mechanical step for one of skill in the art based on the disclosures herein.

Figure 9:
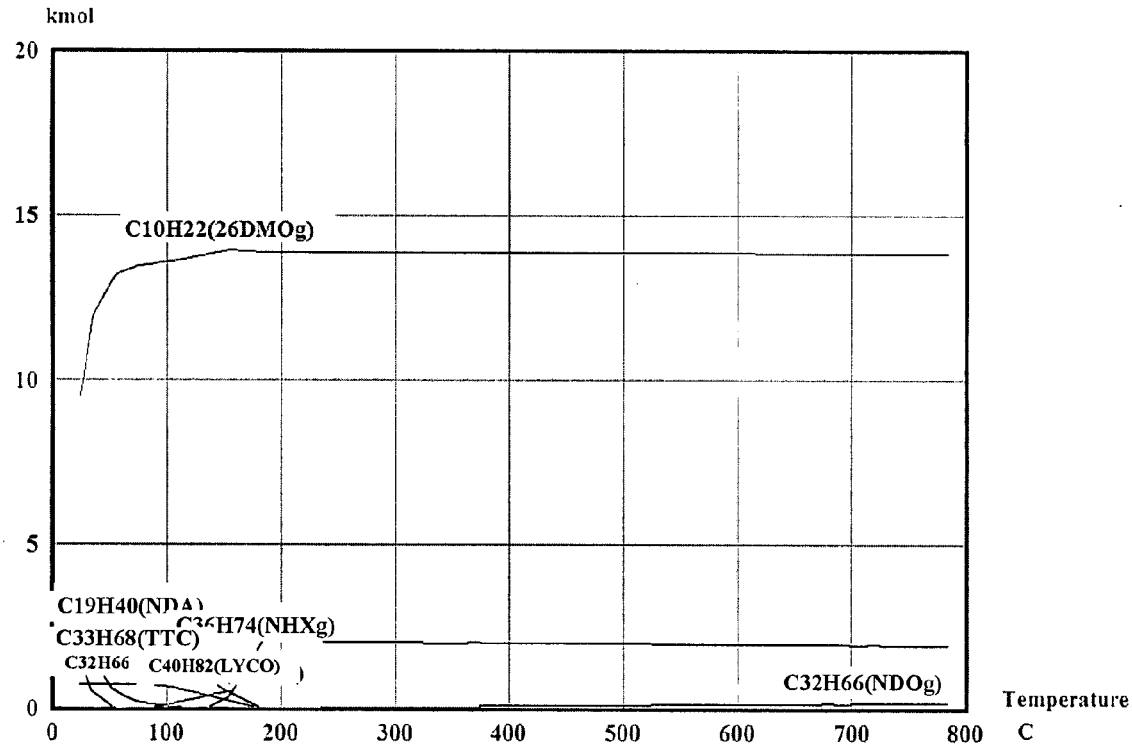
FIG. 9 is an illustration of a gas composition equilibrium diagram, in the presence of excess hydrogen, for a mixture of heavy hydrocarbons in accordance with the present invention.

FIG. 9 is an illustration of a gas composition equilibrium diagram, in the presence of excess hydrogen, for a mixture of heavy hydrocarbons in accordance with the present invention. As the illustration of FIG. 9 shows, relatively short and valuable hydrocarbon chains are thermally favored in the presence of excess hydrogen. Natural gas with a high methane content is rich in excess hydrogen. Therefore, heating the product gas and passing it across a catalyst where natural gas is used as the thermal conduit and produced with the heavy hydrocarbons may generate commercially valuable short chain hydrocarbons. In one embodiment, a platinum catalyst may be used, although other catalysts are known in the art and contemplated within the scope of the invention. The presence of a catalyst does not change the equilibrium diagrams, but may advance the kinetics of the reactions to make break down heavy hydrocarbons at a commercially valuable rate.

The recycling gas 122, 132 used to heat the oil shale and start pyrolysis of the kerogen in the target zone 112 also dilutes the vaporized oil and carries it to the surface. In addition, the large volume of excess natural gas reduces the amount of condensation of the oil vapor until it can be further processed. To prevent damage to the expensive catalysts in the hydrocracking reactor 138, the present invention may employ standard oil hydrotreating technology to remove sulfur, nitrogen, and heavy metals, such as arsenic, from the production stream, before it passes on to the hydrocracking reactor 138.

The schematic flow chart diagrams herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 10:
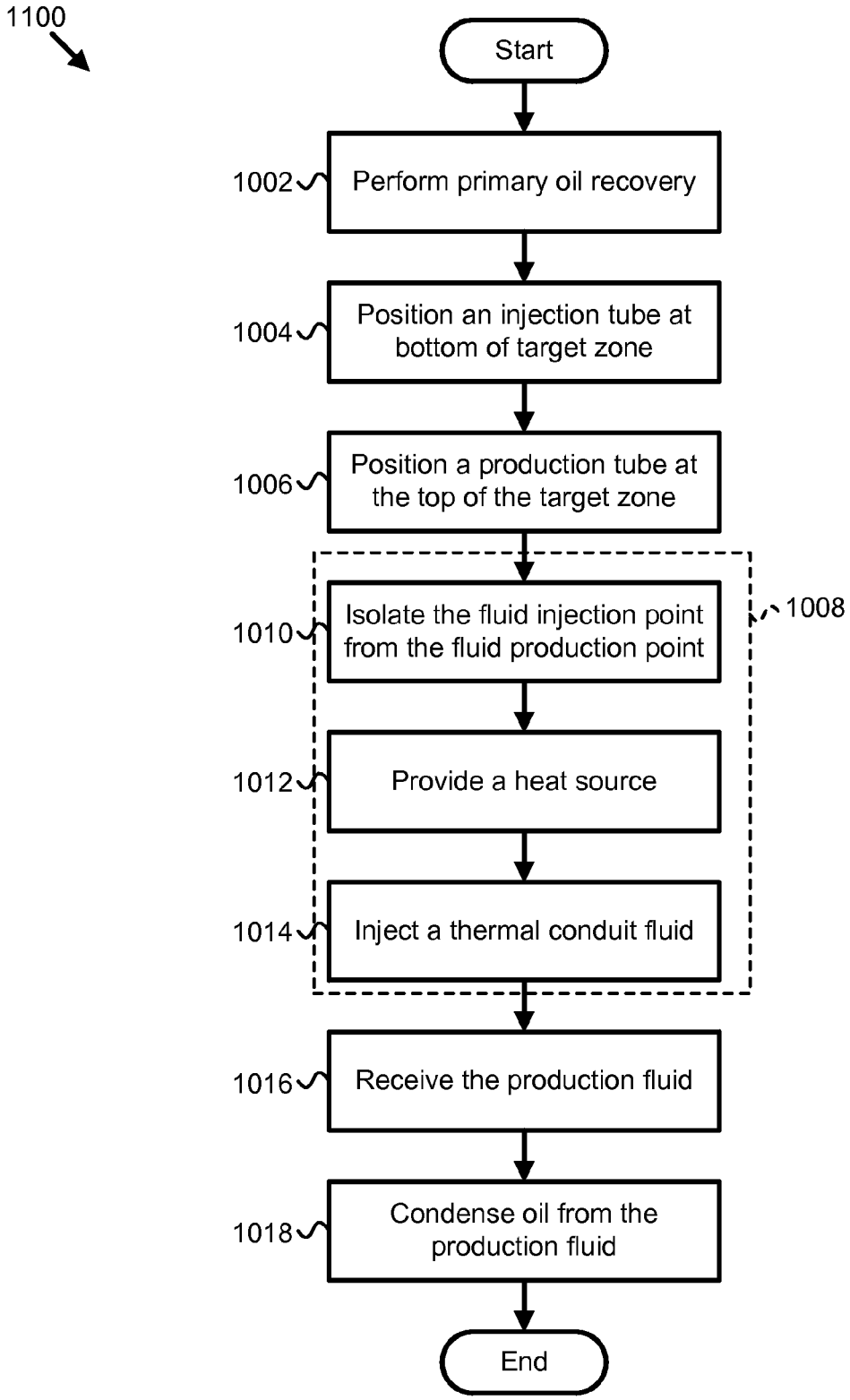
FIG. 10 is a schematic flow chart illustrating one embodiment of a method for extracting hydrocarbons in-situ in accordance with the present invention.

FIG. 10 is a schematic flow chart illustrating one embodiment of a method 1000 for extracting hydrocarbons in-situ in accordance with the present invention. The method 1000 may include performing 1002 a primary oil recovery on a target zone 112, wherein the remainder of the method 1000 comprises a secondary oil recovery on the target zone 112. For example, performing 1002 the primary oil recovery may comprise drilling a well 102 through the target zone 112, casing the well 102, stimulating the target zone 112, and flowing oil from the target zone 112 until the target zone 112 no longer delivers a commercially viable amount of oil to the wellbore 102.

The method 1000 continues with a completion unit 106 positioning 1004 an injection tube 108 near a fluid injection point 110 substantially at the bottom of a target zone 110 of a hydrocarbon-bearing formation 104. The method 1000 continues with the completion unit 106 positioning 1006 a production tube 114 near a fluid production point 116 substantially at the top of the target zone 112. The method 1000 includes producing 1008 hydrocarbons from the target zone 112.

Producing 1008 hydrocarbons from the target zone 112 includes an isolation unit 118 isolating 1010 the fluid injection point 110 from fluid communication with the fluid production point 116 such that fluid flowing from the fluid injection point 110 to the fluid production point 116 flows through the target zone 112. A heat source 124 is provided 1012. Producing 1108 hydrocarbons from the target zone 112 further includes an injection unit 120 injecting 1014 a thermal conduit fluid 122 into the fluid injection point 110 at a pressure selected to displace fluids within the target zone 112, wherein the thermal conduit fluid 122 conducts thermal energy from the at least one heat source 124 to the target zone 112 such that the thermal conduit fluid 122 entrains hydrocarbons from the target zone 112 to generate a production fluid 132.

The method 1000 further includes a production unit receiving 1016 the production fluid 132. In one embodiment, the hydrocarbon comprises and oil, the thermal conduit fluid 122 entrains the oil by vaporizing the oil in the target zone 112, and receiving the production fluid 132 further includes a condenser 150 condensing 1018 oil from the production fluid 132.

Figure 11:
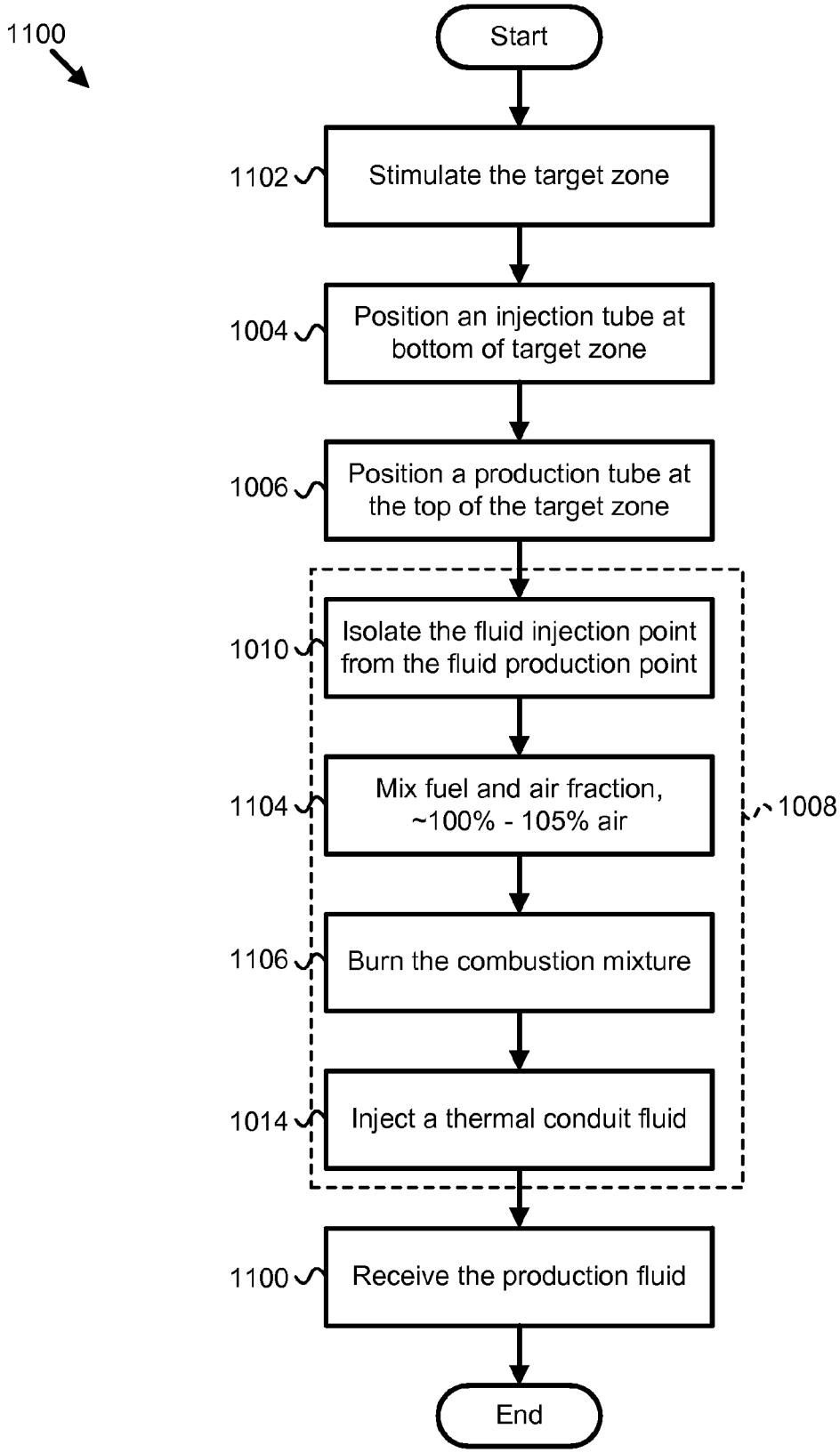
FIG. 11 is a schematic flow chart illustrating an alternate embodiment of a method for extracting hydrocarbons in-situ in accordance with the present invention.

FIG. 11 is a schematic flow chart illustrating an alternate embodiment of a method 1100 for extracting hydrocarbons in-situ in accordance with the present invention. The method 1100 includes a stimulation unit (not shown) stimulating 1102 the target zone 112. The method 1100 continues with a completion unit 106 positioning 1004 an injection tube 108 near a fluid injection point 110 substantially at the bottom of a target zone 110 of a hydrocarbon-bearing formation 104. The method 1100 continues with the completion unit 106 positioning 1006 a production tube 114 near a fluid production point 116 substantially at the top of the target zone 112. The method 1100 includes producing 1008 hydrocarbons from the target zone 112.

Producing 1008 hydrocarbons from the target zone 112 includes an isolation unit 118 isolating 1010 the fluid injection point 110 from fluid communication with the fluid production point 116 such that fluid flowing from the fluid injection point 110 to the fluid production point 116 flows through the target zone 112. A mixer 127 mixes 1104 an air fraction 128 and a fuel fraction 126, such that the combustion mixture 129 has 100% to 105% of a stoichiometric amount of air, and a burner 124 burns 1106 the combustion mixture 129 to provide heat for a heat exchanger 130 to heat a thermal conduit fluid 122. Producing 1108 hydrocarbons from the target zone 112 further includes an injection unit 120 injecting 1014 a thermal conduit fluid 122 into the fluid injection point 110 at a pressure selected to displace fluids within the target zone 112, wherein the thermal conduit fluid 122 conducts thermal energy from the at least one heat source 124 to the target zone 112 such that the thermal conduit fluid 122 entrains hydrocarbons from the target zone 112 to generate a production fluid 132. The method 1100 concludes with a production unit receiving 1016 the production fluid 132.

Figure 12:
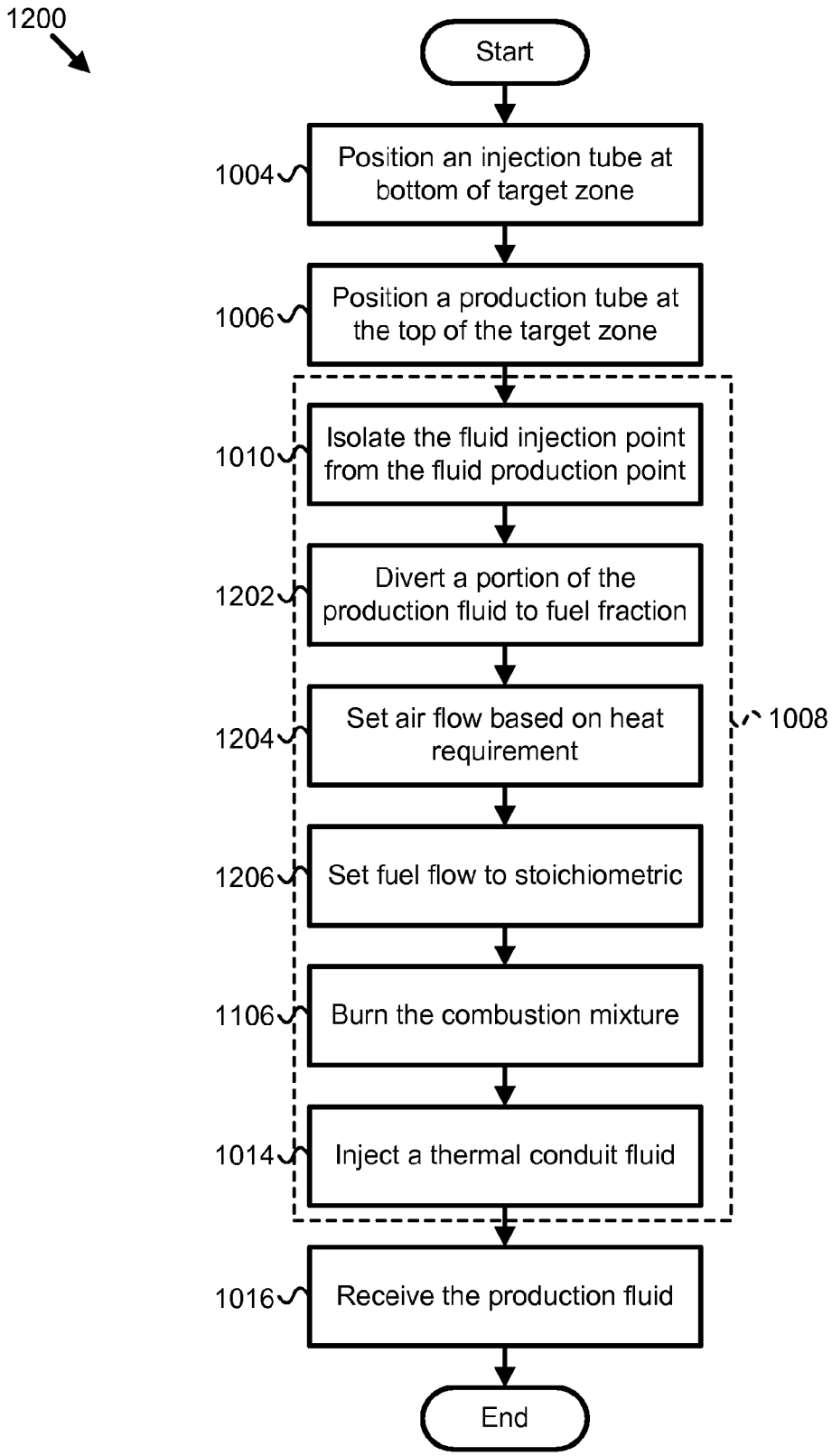
FIG. 12 is a schematic flow chart illustrating an alternate embodiment of a method for extracting hydrocarbons in-situ in accordance with the present invention.

FIG. 12 is a schematic flow chart illustrating an alternate embodiment of a method 1200 for extracting hydrocarbons in-situ in accordance with the present invention. The method 1200 includes a completion unit 106 positioning 1004 an injection tube 108 near a fluid injection point 110 substantially at the bottom of a target zone 110 of a hydrocarbon-bearing formation 104. The method 1200 continues with the completion unit 106 positioning 1006 a production tube 114 near a fluid production point 116 substantially at the top of the target zone 112. The method 1200 includes producing 1008 hydrocarbons from the target zone 112.

Producing 1008 hydrocarbons from the target zone 112 includes an isolation unit 118 isolating 1010 the fluid injection point 110 from fluid communication with the fluid production point 116 such that fluid flowing from the fluid injection point 110 to the fluid production point 116 flows through the target zone 112. Producing 1008 hydrocarbons from the target zone 112 further includes diverting 1202 a portion of a production fluid 132 to a fuel fraction 126 sent to a burner 124. An air-fuel module 206 sets 1204 an air flow target 212 based on a heat requirement 214, and sets 1206 a fuel flow target 210 such that a combustion mixture 129 approximates a stoichiometric mixture. Producing 1008 hydrocarbons from the target zone 112 further includes a burner 124 burning 1106 the combustion mixture 129 to provide heat for a heat exchanger 130 to heat a thermal conduit fluid 122, and an injection unit 120 injecting 1014 a thermal conduit fluid 122 into the fluid injection point 110 at a pressure selected to displace fluids within the target zone 112, wherein the thermal conduit fluid 122 conducts thermal energy from the at least one heat source 124 to the target zone 112 such that the thermal conduit fluid 122 entrains hydrocarbons from the target zone 112 to generate a production fluid 132. The method 1200 concludes with a production unit receiving 1016 the production fluid 132.

Figure 13:
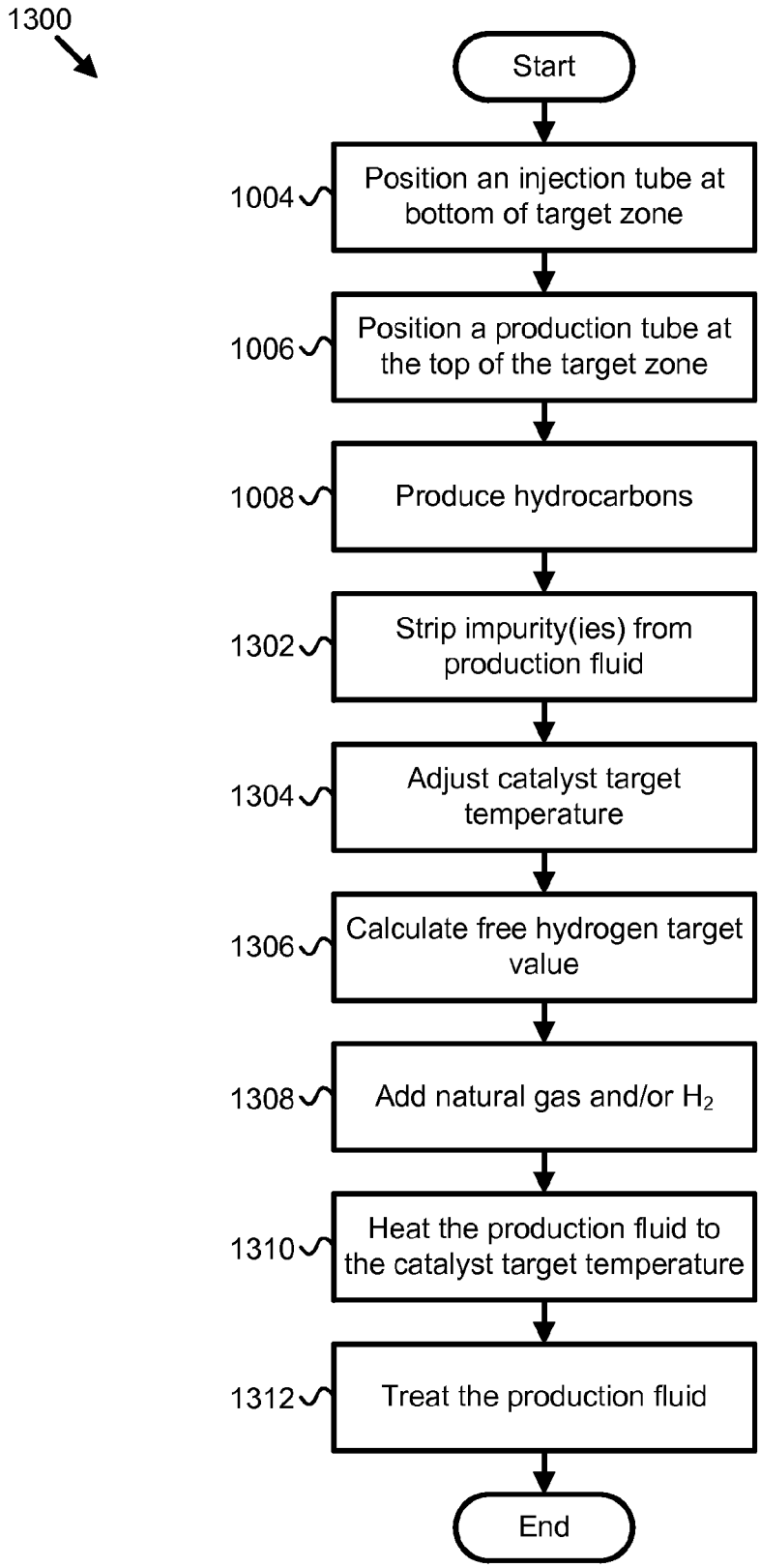
FIG. 13 is a schematic flow chart illustrating an alternate embodiment of a method for extracting hydrocarbons in-situ in accordance with the present invention.

FIG. 13 is a schematic flow chart illustrating an alternate embodiment of a method 1300 for extracting hydrocarbons in-situ in accordance with the present invention. The method 1300 includes a completion unit 106 positioning 1004 an injection tube 108 near a fluid injection point 110 substantially at the bottom of a target zone 110 of a hydrocarbon-bearing formation 104. The method 1300 continues with the completion unit 106 positioning 1006 a production tube 114 near a fluid production point 116 substantially at the top of the target zone 112. The method 1300 includes producing 1008 hydrocarbons from the target zone 112.

The method 1300 continues with a scrubber 154 stripping 1302 at least one impurity from the production fluid 132 before treating the production fluid 132 in the catalytic reactor 138. The method 1300 further includes a reactor conditions module 204 adjusting 1304 a catalyst target temperature 222 and calculating 1306 a free hydrogen target value 224 based on a composition of the production fluid 132. A product heat exchanger 136 heats 1308 the production fluid to the catalyst target temperature 222, and a pump 144 adds 1310 natural gas and/or hydrogen to the production fluid. The method 1300 concludes with a catalytic reactor 138 treating 1312 the production fluid 132 to reduce an average molecular weight of the production fluid 132.

Figure 14:
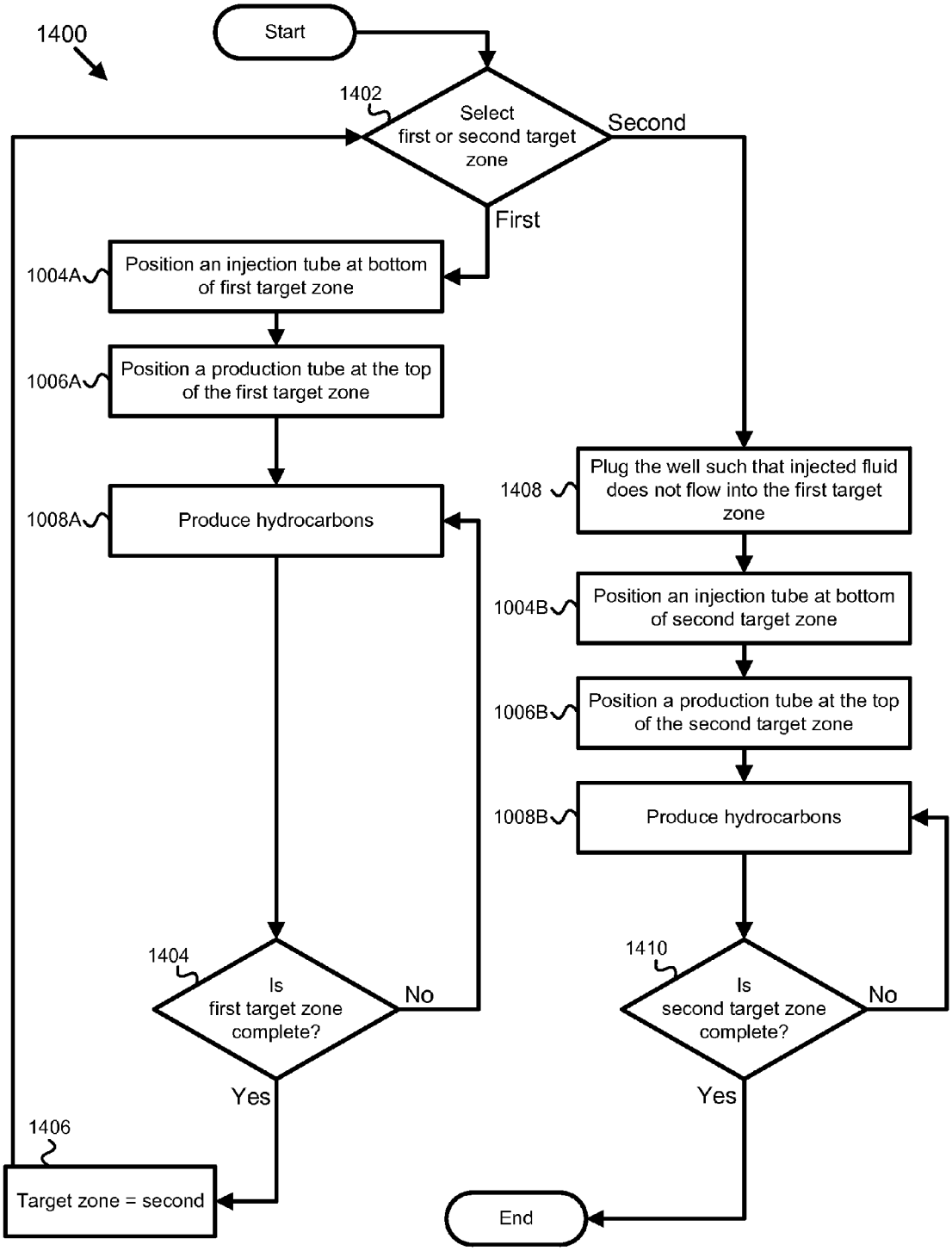
FIG. 14 is a schematic flow chart illustrating an alternate embodiment of a method for extracting hydrocarbons in-situ in accordance with the present invention.

FIG. 14 is a schematic flow chart illustrating an alternate embodiment of a method 1400 for extracting hydrocarbons in-situ in accordance with the present invention. The method

1400 begins with determining 1402 whether a first or second target zone 112A, 112B is a current treated zone. If the first zone 112A is the treated zone, the method 1400 includes a completion unit 106 positioning 1004A an injection tube 108 near a fluid injection point 110 substantially at the bottom of a target zone 112A of a hydrocarbon-bearing formation 104. The method 1400 continues with the completion unit 106 positioning 1006A a production tube 114 near a fluid production point 116 substantially at the top of the target zone 112A. The method 1400 includes producing 1008A hydrocarbons from the target zone 112A. The method 1400 includes checking 1404 whether the first target zone 112A is completed producing, and setting 1406 a target zone to the second target zone 112B.

The method 1400 further includes selecting 1402 the second target zone 112B, and a completion unit 106 plugging 1408 the well 102 such that injected fluid 122 does not enter the first target zone 112A, but rather enters the second target zone 112B. The method 1400 includes a completion unit 106 positioning 1004B an injection tube 108 near a fluid injection point 110 substantially at the bottom of a target zone 112B of a hydrocarbon-bearing formation 104. The method 1400 continues with the completion unit 106 positioning 1006B a production tube 114 near a fluid production point 116 substantially at the top of the target zone 112B. The method 1400 includes producing 1008B hydrocarbons from the target zone 112B. The method 1400 concludes with producing the second target zone 112B until a check 1410 indicates the second target zone 112B is completed producing.

What is claimed is:

1. A method for extracting hydrocarbons in-situ, the method comprising:

positioning an injection tube within a wellbore near a fluid injection point, the fluid injection point substantially at the bottom of a target zone of a hydrocarbon-bearing formation;

positioning a production tube near a fluid production point substantially at the top of the target zone;

isolating, within the wellbore, the fluid injection point from fluid communication with the fluid production point to direct fluid flowing from the fluid injection point through the target zone and to the fluid production point; and producing hydrocarbons from the top of target zone by:

providing at least one heat source;

injecting a thermal conduit fluid through the injection tube into hydrocarbon-bearing material of the target zone of the hydrocarbon-bearing formation, the thermal conduit fluid dispersing, substantially adjacent to the wellbore, directly into the hydrocarbon-bearing material of the target zone at the fluid injection point, the thermal conduit fluid injected at a pressure selected to displace fluids within the target zone, wherein the thermal conduit fluid conducts thermal energy from the at least one heat source to the target zone such that the thermal conduit fluid entrains hydrocarbons from the target zone by vaporizing the hydrocarbons to generate a production fluid such that the production fluid rises through the target zone;

receiving the production fluid at the fluid production point substantially at the top of the target zone;

interpreting a composition of the production fluid and adjusting a catalyst target temperature based on the composition of the production fluid;

heating, using a product heat exchanger, the production fluid to the catalyst target temperature; and treating, using a catalytic reactor, the production fluid, thereby reducing an average molecular weight of the production fluid.

2. The method of claim 1, wherein the at least one heat source comprises at least one heat source selected from the group consisting of a combustion reaction and a solar concentrator.

3. The method of claim 1, wherein the at least one heat source comprises a combustion reaction, the method further comprising mixing a fuel fraction and an air fraction to create a combustion mixture, and burning the combustion mixture to produce the combustion reaction, wherein the thermal conduit fluid receives thermal energy from the combustion reaction without mixing with combustion products from the combustion reaction.

4. The method of claim 1, wherein the at least one heat source comprises a combustion reaction, the method further comprising mixing a fuel fraction and an air fraction to create a combustion mixture, and burning the combustion mixture to produce the combustion reaction, the method further comprising diverting a portion of the production fluid into the fuel fraction of the combustion mixture.

5. The method of claim 4, wherein the fuel fraction comprises a fuel composition and a fuel flow, wherein the air fraction comprises an air composition and an air flow, the method further comprising modulating the air flow and the fuel flow based on a heat requirement and the fuel composition.

6. The method of claim 5, wherein modulating the air flow and the fuel flow comprises modulating the air flow and the fuel flow such that the combustion mixture approximates a stoichiometric mixture.

7. The method of claim 5, further comprising modulating the air flow based on the heat requirement, and modulating the fuel flow such that the combustion mixture approximates a stoichiometric mixture.

8. The method of claim 5, wherein modulating the air flow and the fuel flow comprises modulating the air flow and the fuel flow such that the combustion mixture approximates a mixture having between about 1 and about 1.05 times a stoichiometric amount of air.

9. The method of claim 1, wherein the hydrocarbon-bearing formation comprises an oil-bearing formation, and wherein the method comprises a secondary recovery operation on the oil-bearing formation.

10. The method of claim 1, wherein the hydrocarbon-bearing formation comprises one of an oil shale formation and a tar sand formation.

11. The method of claim 1, the method further comprising stripping at least one impurity from the production fluid before treating the production fluid in the catalytic reactor.

12. The method of claim 1, the method further comprising adding natural gas to the production fluid before treating the production fluid in the catalytic reactor.

13. The method of claim 12, wherein adding natural gas to the production fluid comprises calculating a free hydrogen target value based on the composition of the production fluid, and adding a calculated quantity of natural gas to the production fluid to achieve the free hydrogen target value for the production fluid.

14. The method of claim 1, wherein a hydrocarbon in the hydrocarbon-bearing formation comprises an oil, wherein the thermal conduit fluid entrains the oil by vaporizing the oil into the production fluid, and wherein receiving the production fluid further comprises condensing the oil from the production fluid back to liquid oil at a surface location.

15. The method of claim 1, wherein the wellbore comprises a single vertical well, wherein the target zone comprises a first target zone, the method further comprising plugging the wellbore above the first target zone, positioning the injection tube near a second fluid injection point substantially at the bottom of a second target zone, positioning the production tube near a second fluid production point substantially at the top of the second target zone, isolating the second fluid injection point from fluid communication with the second fluid production point within the wellbore, and producing hydrocarbons from the second target zone.

16. The method of claim 1, wherein the wellbore comprises a first horizontal well segment and a second horizontal well segment, wherein the fluid production point is disposed within the first horizontal well segment and the fluid injection point is disposed within the second horizontal well segment, and wherein the target zone comprises a first target zone and a second target zone, the second horizontal well segment positioned deeper than the first horizontal well segment, at least a portion of the first horizontal well segment and the second horizontal well segment in contact with each of the first target zone and the second target zone, the first target zone disposed further from a well head than the second target zone, the method further comprising plugging the first horizontal well segment and the second horizontal well segment such that injected fluid into the first or second horizontal well segment does not enter the first target zone, the method further comprising positioning the injection tube near a second fluid injection point substantially at the bottom of a second target zone, positioning the production tube near a second fluid production point substantially at the top of the second target zone, isolating the second fluid injection point from fluid communication with the second fluid production point within the wellbore, and producing hydrocarbons from the second target zone.

17. The method of claim 1, further comprising stimulating the target zone to create at least one stimulated region that improves fluid communication between the fluid injection point and the target zone but does not provide a stimulated flowpath through the target zone connecting the fluid injection point and the fluid production point.

18. The method of claim 17, wherein stimulating the target zone comprises detonating an explosive.

19. The method of claim 1, wherein the at least one heat source comprises an offset well, wherein the thermal conduit fluid conducts heat from the at least one heat source to the target zone by the thermal conduit fluid circulating through a high temperature zone in the offset well.

20. The method of claim 1, wherein the fluid injection point comprises a fluid communication between the wellbore and an area substantially adjacent to the wellbore such that the thermal conduit fluid is injected into the hydrocarbon-bearing material of the target zone at a position substantially adjacent to the wellbore without entering a manmade structure configured to carry the thermal conduit fluid away from the wellbore.

21. A system for extracting hydrocarbons in-situ, the system comprising:

at least one well drilled through a hydrocarbon-bearing formation;

a completion unit configured to position an injection tube within a wellbore near a fluid injection point, the fluid injection point substantially at the bottom of a target zone of the hydrocarbon-bearing formation, the completion unit further configured to position a production tube near a fluid production point substantially at the top of the target zone;

an isolation unit that isolates, within the wellbore, the fluid injection point from fluid communication with the fluid production point to direct fluid flowing from the fluid injection point through the target zone and to the fluid production point;

a heat source;

an injection unit that injects a thermal conduit fluid through the injection tube into hydrocarbon-bearing material of the target zone of the hydrocarbon-bearing formation, the thermal conduit fluid dispersing, substantially adjacent to the wellbore, directly into the hydrocarbon-bearing material of the target zone at the fluid injection point, the thermal conduit fluid injected at an injection pressure selected to displace fluids within the target zone;

a heat exchanger that transfers thermal energy from the heat source to the thermal conduit fluid such that the thermal conduit fluid is injected at a temperature sufficient to entrain hydrocarbons from the target zone by vaporizing the hydrocarbons, thereby generating a production fluid that rises through the target zone;

a production unit that returns the production fluid to a surface location through the fluid production point disposed substantially at the top of the target zone;

a reactor conditions module that interprets a composition of the production fluid and adjusts a catalyst target temperature based on the composition of the production fluid;

a product heat exchanger that heats the production fluid to the catalyst target temperature; and a catalytic reactor that treats the production fluid, thereby reducing an average molecular weight of the production fluid.

22. The system of claim 21, wherein the reactor conditions module is further configured to calculate a free hydrogen target value, the system further comprising a natural gas supply that adds natural gas to the production fluid based on the free hydrogen target value and the composition of the production fluid.

23. The system of claim 21, wherein the hydrocarbon-bearing formation comprises an oil, wherein the thermal conduit fluid entrains the hydrocarbons by vaporizing the oil into the production fluid, the system further comprising a condenser that condenses the oil from the production fluid back to liquid oil at a surface location.

24. The system of claim 21, wherein the hydrocarbon in the hydrocarbon-bearing formation comprises a hydrocarbon selected from the group consisting of: kerogen in an oil shale, hydrocarbons remaining after a primary oil recovery, hydrocarbons in a tar sand, and heavy oil.

25. The system of claim 21, wherein the fluid production point is substantially vertically above the fluid injection point, and wherein the at least one well comprises a vertical well.

26. The system of claim 21, wherein the fluid production point is substantially vertical above the fluid injection point, and wherein the fluid production point is disposed within a first horizontal well segment and the fluid injection point is disposed within a second horizontal well segment.

27. The system of claim 21, wherein the heat source comprises a combustion reaction, the system further comprising a mixer that mixes an air fraction and a fuel fraction to create a combustion mixture, and a burner that burns the combustion mixture, wherein the fuel fraction comprises a fuel flow and fuel composition, wherein the air fraction comprises an air flow and air composition, the system further comprising an operating conditions module configured to interpret the air composition and the fuel composition, the system further comprising an air-fuel module configured to modulate the air flow and the fuel flow based on a heat requirement and the fuel composition.

28. The system of claim 27, wherein the air-fuel module is further configured to modulate the air flow based on the heat requirement, and to modulate the fuel flow such that the combustion mixture approximates a stoichiometric mixture.

29. An apparatus for extracting hydrocarbons in-situ, the apparatus comprising:

a completion unit configured to position an injection tube within a wellbore near a fluid injection point, the fluid injection point substantially at the bottom of a target zone of a hydrocarbon-bearing formation, the completion unit further configured to position a production tube near a fluid production point substantially at the top of the target zone;

an isolation unit that isolates, within the wellbore, the fluid injection point from fluid communication with the fluid production point to direct fluid flowing from the fluid injection point through the target zone and to the fluid production point;

a heat source;

an injection unit that injects a thermal conduit fluid through the injection tube into hydrocarbon-bearing material of the target zone of the hydrocarbon-bearing formation, the thermal conduit fluid dispersing, substantially adjacent to the wellbore, directly into the hydrocarbon-bearing material of the target zone at the fluid injection point, the thermal conduit fluid injected at an injection pressure selected to displace fluids within the target zone;

a heat exchanger that transfers thermal energy from the heat source to the thermal conduit fluid such that the thermal conduit fluid is injected at a temperature sufficient to entrain hydrocarbons from the target zone by vaporizing the hydrocarbons, thereby generating a production fluid that rises through the target zone;

a production unit that returns the production fluid to a surface location through the fluid production point disposed substantially at the top of the target zone;

a reactor conditions module that interprets a composition of the production fluid and adjusts a catalyst target temperature based on the composition of the production fluid;

a product heat exchanger that heats the production fluid to the catalyst target temperature; and a catalytic reactor that treats the production fluid, thereby reducing an average molecular weight of the production fluid.

30. The apparatus of claim 29, wherein the heat source comprises a combustion reaction in a burner disposed within a wellbore, wherein the heat exchanger is disposed within the wellbore, and wherein the heat exchanger transfers heat from the combustion reaction to the thermal conduit fluid and prevents combustion products from mixing with the thermal conduit fluid.

31. The apparatus of claim 29, wherein the heat source comprises a combustion reaction in a burner, wherein the heat exchanger transfers heat from the combustion reaction to the thermal conduit fluid and prevents combustion products from mixing with the thermal conduit fluid, and wherein the injection tube further comprises an insulating layer.

32. The apparatus of claim 31, wherein the injection tube further comprises a member selected from the group consisting of concentric coiled tubing, vacuum insulated tubing (VIT), insulated tubing, and concentric tubing.

33. The apparatus of claim 29, wherein the heat source comprises a combustion reaction, the apparatus further comprising a mixer that mixes an air fraction and a fuel fraction to create a combustion mixture, and a burner that burns the combustion mixture, wherein the fuel fraction comprises a fuel flow and fuel composition, wherein the air fraction comprises an air flow and air composition, the apparatus further comprising an operating conditions module configured to interpret the air composition and the fuel composition, the apparatus further comprising an air-fuel module configured to modulate the air flow and the fuel flow based on a heat requirement and the fuel composition.

34. The apparatus of claim 33, wherein the air-fuel module is further configured to modulate the air flow based on the heat requirement, and to modulate the fuel flow such that the combustion mixture has at least as much air as a stoichiometric mixture.

35. The apparatus of claim 29, wherein the isolation unit comprises a packer configured to prevent the thermal conduit fluid from traveling up a backside of the injection tube.

* * * * *